US010649368B2

(12) United States Patent
Hijikata et al.

(10) Patent No.: US 10,649,368 B2
(45) Date of Patent: May 12, 2020

(54) IMAGE FORMING APPARATUS

(71) Applicant: CANON KABUSHIKI KAISHA, Tokyo (JP)

(72) Inventors: Shunsuke Hijikata, Yokohama (JP); Ryota Shibuya, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/570,812

(22) Filed: Sep. 13, 2019

(65) Prior Publication Data

US 2020/0004176 A1 Jan. 2, 2020

Related U.S. Application Data

(63) Continuation of application No. 16/135,978, filed on Sep. 19, 2018, now Pat. No. 10,444,665.

(30) Foreign Application Priority Data

Oct. 3, 2017 (JP) ..... 2017-193781

(51) Int. Cl.

| | |
|---|---|
| ***G03G 15/08*** | (2006.01) |
| ***G03G 21/18*** | (2006.01) |
| ***G03G 21/16*** | (2006.01) |

(52) U.S. Cl.

CPC ..... *G03G 15/0865* (2013.01); *G03G 21/1647* (2013.01); *G03G 21/1842* (2013.01); *G03G 2215/0692* (2013.01)

(58) Field of Classification Search

CPC ..... G03G 15/0865; G03G 21/1647; G03G 21/1842; G03G 2215/0692

See application file for complete search history.

(56) References Cited

U.S. PATENT DOCUMENTS 5,168,308 A * 12/1992 Hiraike ..... G03G 21/1853 399/125
5,210,573 A * 5/1993 Fukuchi ..... G03G 21/1864 399/111
5,365,315 A * 11/1994 Baker ..... G03G 21/1832 399/111
5,561,496 A * 10/1996 Sugiura ..... G03G 15/00 29/469
5,634,178 A * 5/1997 Sugiura ..... G03G 15/757 399/107

(Continued)

*Primary Examiner* — David J Bolduc

(74) *Attorney, Agent, or Firm* — Canon U.S.A., Inc. IP Division

(57) ABSTRACT

An image forming apparatus including a first unit having an image bearing member, a second unit having a development member, an apparatus main body which includes an opening portion, an opening-closing member to open or close the opening portion, a first portion contacting with a part of the first unit to position the first unit to the apparatus main body, and a second portion arranged on an opposite side of the first portion with respect to the image bearing member, and a sandwiched unit movable between a first position at which the sandwiched unit is sandwiched between the first unit and the second portion and a second position at which the sandwiched unit is not sandwiched, wherein when the sandwiched unit is located at the first position, a part of the first unit is urged against the first portion by the sandwiched unit.

18 Claims, 25 Drawing Sheets

(56) References Cited

U.S. PATENT DOCUMENTS 5,678,139 A * 10/1997 Nomura ..... G03G 21/1864 399/114
5,697,022 A * 12/1997 Matsuda ..... G03G 21/1832 399/102
5,787,323 A * 7/1998 Nomura ..... G03G 21/1853 399/111
5,835,822 A * 11/1998 Nagasaki ..... B41J 2/43 399/111
5,867,751 A * 2/1999 Nomura ..... G03G 15/0216 399/111
5,878,304 A * 3/1999 Watanabe ..... G03G 21/1832 399/92
5,930,561 A * 7/1999 Hosokawa ..... G03G 21/1821 399/111
5,983,054 A * 11/1999 Kameyama ..... G03G 21/1892 399/107
6,229,974 B1 * 5/2001 Noda ..... G03G 21/1853 399/111
7,174,117 B2 * 2/2007 Okabe ..... G03G 15/0896 399/111
2002/0131790 A1 * 9/2002 Sato ..... G03G 21/1832 399/111
2005/0025521 A1 * 2/2005 Mori ..... G03G 21/1842 399/111
2006/0133850 A1 * 6/2006 Nishimura ..... G03G 15/0813 399/113
2006/0193652 A1 * 8/2006 Sato ..... G03G 15/0822 399/90
2007/0166070 A1 * 7/2007 Sato ..... G03G 21/1821 399/90
2008/0145095 A1 * 6/2008 Hoshi ..... G03G 21/1853 399/111
2008/0152386 A1 * 6/2008 Sakaguchi ..... G03G 21/1853 399/114
2009/0003876 A1 * 1/2009 Maeshima ..... G03G 21/1825 399/111
2010/0172673 A1 * 7/2010 Akaike ..... G03G 21/12 399/258
2011/0076055 A1 * 3/2011 Lee ..... G03G 21/1633 399/110
2011/0170905 A1 * 7/2011 Furuya ..... G03G 21/1853 399/111
2011/0211868 A1 * 9/2011 Yamamoto ..... G03G 15/0879 399/119
2011/0243601 A1 * 10/2011 Furuya ..... G03G 21/1842 399/111
2011/0299873 A1 * 12/2011 Ushiozu ..... G03G 21/1666 399/90
2011/0311269 A1 * 12/2011 Murooka ..... G03G 15/6502 399/110
2013/0259518 A1 * 10/2013 Miwa ..... G03G 21/1633 399/110
2013/0259520 A1 * 10/2013 Miwa ..... G03G 21/1633 399/110
2014/0205316 A1 * 7/2014 Lee ..... G03G 21/1839 399/110
2014/0205318 A1 * 7/2014 Lee ..... G03G 21/1853 399/111
2015/0050042 A1 * 2/2015 Sato ..... G03G 21/1842 399/110
2015/0055978 A1 * 2/2015 Izumi ..... G03G 15/0921 399/119
2015/0205255 A1 * 7/2015 Mori ..... G03G 21/1821 399/113
2016/0170371 A1 * 6/2016 Kubo ..... G03G 21/1842 399/110
2017/0153597 A1 * 6/2017 Sato ..... G03G 21/1814
2018/0088525 A1 * 3/2018 Okamoto ..... G03G 21/1647

* cited by examiner

IMAGE FORMING APPARATUS

The present application is a continuation of U.S. patent application Ser. No. 16/135,978, filed Sep. 19, 2018, entitled "IMAGE FORMING APPARATUS", the content of which is expressly incorporated by reference herein in its entirety. Further, the present application claims priority from Japanese Patent Application No. 2017-193781, Oct. 3, 2017, which is also hereby incorporated by reference herein in its entirety.

BACKGROUND OF THE INVENTION

Field of the Invention

The present invention relates to an image forming apparatus which forms an image on a recording medium and discharges the recording medium. In particular, the present invention relates to an image forming apparatus in which a cartridge consisting of components necessary to be replaced according to use of the apparatus is detachably attached to an apparatus main body and the cartridge.

Description of the Related Art

The above-described image forming apparatus includes an opening-closing cover which a user rotationally moves to expose an inner portion of the apparatus main body to attach or detach the cartridge. There is provided an opening-closing cover having a cartridge push-in unit which enables the cartridge to be pushed into an image forming position through a closing operation of the opening-closing cover in a case where the cartridge is insufficiently inserted to the apparatus main body (Japanese Patent No. 5773675).

In the image forming apparatus having the cartridge push-in unit, because the cartridge is pushed into the image forming position by using a force for closing the opening-closing cover, a large force is necessary for closing the opening-closing cover. In particular, in the image forming apparatus having a pressing spring for urging the cartridge to a normal position, the cartridge has to be inserted to the image forming position against the pressing force of the pressing spring. Hence, in a case where the cartridge is pushed into the image forming position with the opening-closing cover, a load necessary for operating the opening-closing cover is increased, so that usability thereof is lowered.

SUMMARY OF THE INVENTION

According to an aspect of the present invention, an image forming apparatus includes a first unit including an image bearing member capable of rotating while bearing a toner image, a second unit including a development roller which supplies toner to the image bearing member to develop the toner image, an apparatus main body to which the first unit is detachably attached in a direction intersecting with a rotation axis of the image bearing member, the apparatus main body including an opening portion through which the first unit passes when the first unit is to be attached to or detached from the apparatus main body, an opening-closing member which can be moved to open or close the opening portion, a first portion which is in contact with a part of the first unit to position the first unit with respect to the apparatus main body, and a second portion, which does not move together with the opening-closing member, arranged on an opposite side of the first portion with respect to the image bearing member in the intersecting direction, and a sandwiched unit configured to be movable between a first position at which the sandwiched unit is sandwiched between the first unit and the second portion to press the first unit against the first portion and a second position at which the sandwiched unit is not sandwiched between the first unit and the second portion, wherein, when the sandwiched unit is located at the first position, a part of the first unit is urged and brought into contact with the first portion by the sandwiched unit.

According to another aspect of the present invention, a cartridge detachably attached to an apparatus main body of an image forming apparatus including an opening portion through which the cartridge passes when the cartridge is to be attached to the apparatus main body, an opening-closing member which can be moved to open or close the opening portion, a first portion which positions the cartridge with respect to the apparatus main body, and a second portion which does not move together with the opening-closing member, and a sandwiched unit which is sandwiched between the cartridge and the second portion, includes an image bearing member configured to bear a toner image, and a frame supporting the image bearing member so that the image bearing member is rotatable, wherein the frame member includes a sandwiching portion formed into a concave shape which sandwiches the sandwiched unit with the second portion in a case where the cartridge is attached to the apparatus main body.

Further features of the present invention will become apparent from the following description of exemplary embodiments with reference to the attached drawings.

DESCRIPTION OF THE EMBODIMENTS

Figure 1:
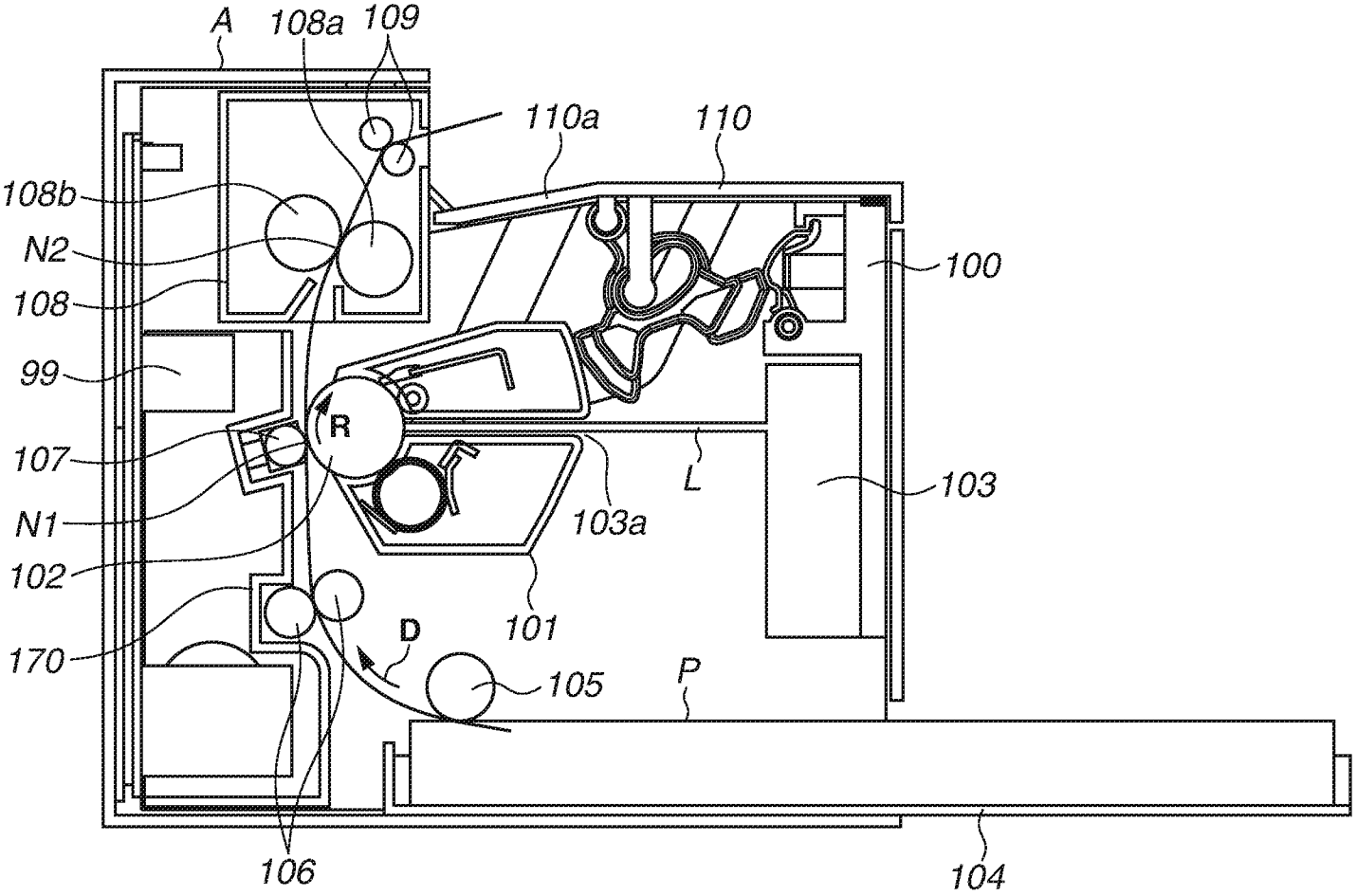
FIG. 1 is a cross-sectional diagram of an apparatus main body of an image forming apparatus and a cartridge according to a first exemplary embodiment.

Hereinafter, an exemplary embodiment of the present invention will be described in detail with reference to the appended drawings. A rotation axis line direction of an electrophotographic photosensitive drum (photosensitive drum) is defined as a lengthwise direction. Further, in the lengthwise direction, a side on which the photosensitive drum receives a driving force from the apparatus main body is defined as a drive side, whereas another side thereof is defined as a non-drive side. A general configuration and image forming processing will be described with reference to FIG. 1. FIG. 1 is a cross-sectional diagram of an apparatus main body A of the image forming apparatus according to the present exemplary embodiment. Herein, the apparatus main body A refers to a portion of the image forming apparatus excluding a cartridge 101.

<General Configuration of Image Forming Apparatus>

An image forming apparatus in FIG. 1 is a laser beam printer using an electrophotographic technique, which includes a process cartridge (cartridge) 101 freely attached to or detached from the apparatus main body A. First, a general configuration of the image forming apparatus will be simply described. An exposure device 103 for forming a latent image on a rotatable photosensitive drum 102 of the cartridge 101 is arranged on the apparatus main body A. Further, a sheet feeding tray 104 which stores a recording material P serving as an image forming target is arranged on the lower side of the cartridge 101. Further, the apparatus main body A includes a feeding roller 105, a conveyance roller pair 106, a transfer roller 107, a fixing unit 108, a discharge roller pair 109, and a discharged sheet stacking face 110*a* which are arranged in a conveyance direction D of the recording material P. In addition, the fixing unit 108 is configured of a heating roller 108*a* and a pressure roller 108*b*. Further, a signal substrate 99 for transmitting or receiving various signals is arranged on a face opposite to a conveyance face of a conveyance frame 170. Although the cartridge 101 is held by the apparatus main body A, a holding structure thereof will be described below in detail.

Figure 2:
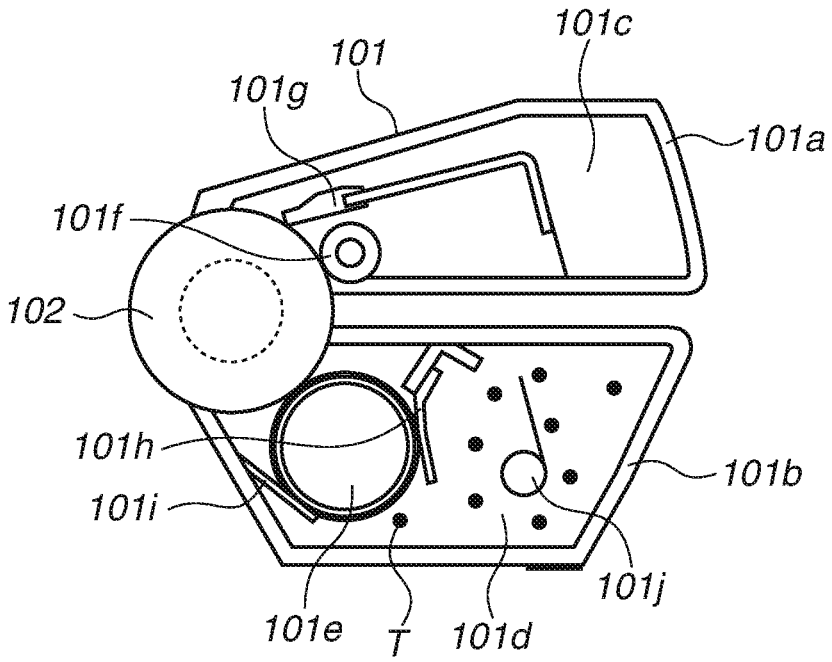
FIG. 2 is a cross-sectional diagram of the cartridge according to the first exemplary embodiment.

FIG. 2 is a cross-sectional diagram of the cartridge 101. The cartridge 101 mainly includes a drum unit (first unit) 101*a* and a development unit (second unit) 101*b*. The drum unit 101*a* includes a cleaning container 101*c*1 having a waste toner chamber 101*c*, and the photosensitive drum (image bearing member) 102, a charging roller 101*f*, and a cleaning blade 101*g* are held by the cleaning container 101*c*1. The development unit 101*b* includes a development container 101*d*1 having a toner chamber 101*d* filled with toner T, and a development roller 101*e*, a development blade 101*h*, a leakage prevention sheet 101*i*, and a conveyance member 101*j* are held by the development container 101*d*1.

<Image Forming Processing>

Next, an outline of the image forming processing will be described with reference to FIGS. 1 and 2. First, a motor (not illustrated) starts rotating based on a print start signal transmitted from the signal substrate 99, so that the photosensitive drum 102 is rotationally driven in a direction indicated by an arrow R at a predetermined circumferential speed (processing speed).

The charging roller 101*f*, to which bias voltage supplied from a power supply apparatus is applied, is in contact with an outer circumferential surface of the photosensitive drum 102, and uniformly charges the outer circumferential surface of the photosensitive drum 102. The exposure device 103 outputs laser light L according to image information. The laser light L passes through a laser opening 103*a* formed in a space between the drum unit 101*a* and the development unit 101*b* of the cartridge 101, so that the outer circumferential surface of the photosensitive drum 102 is exposed to and scanned with the laser light L. Through the above processing, an electrostatic latent image corresponding to the image information is formed on the outer circumferential surface of the photosensitive drum 102.

On the other hand, in the development unit 101*b*, the toner T contained in the toner chamber 101*d* is agitated and conveyed through the rotation of the conveyance member 101*j* and borne on a surface of the development roller 101*e*.

While the toner T is frictionally charged by the development blade 101*h*, a layer thickness of the toner T on the circumferential surface of the development roller 101*e* serving as a developer bearing member is regulated. The toner T is supplied to the photosensitive drum 102, so that the electrostatic latent image is visualized as a toner-T image.

Further, the sheet feeding roller 105 and the conveyance roller pair 106 feed a recording material P stored in the sheet feeding tray 104 arranged in the lower portion of the apparatus main body A while adjusting a timing with an output timing of the laser light L. Then, the recording material P is conveyed to a transfer nip N1 between the photosensitive drum 102 and the transfer roller 107 along the conveyance frame 170. At the transfer nip N1, the toner-T image borne on the photosensitive drum 102 is sequentially transferred to the recording material P from the photosensitive drum 102.

The recording material P on which the toner-T image is transferred is separated from the photosensitive drum 102 and conveyed to the fixing unit 108. Then, the recording material P passes through a fixing nip N2 between the heating roller 108*a* and the pressure roller 108*b* which constitute the fixing device. At the fixing nip N2, fixing processing is executed by applying heat and pressure to the recording material P, so that the toner-T image is fixed on the recording material P. The recording material P on which the fixing processing of the toner-T image is executed is conveyed to the discharge roller pair 109 and discharged to the discharged sheet stacking face 110*a*.

Toner T remaining on the outer circumferential surface of the photosensitive drum 102 after transfer processing is removed by the cleaning blade 101*g*, and the photosensitive drum 102 is used for image forming processing again. The toner T removed from the photosensitive drum 102 is stored in the waste toner chamber 101*c* of the drum unit 101*a*.

In the above, the charging roller 101*f*, the development roller 101*e*, the transfer roller 107, and the cleaning blade 101*g* are processing units acting on the photosensitive drum 102.

<Configuration for Pressing Cartridge>

When the user continuously executes printing, toner T in the cartridge 101 is consumed and eventually used up, so that printing will not be executable. The user, therefore, opens the cartridge door (opening-closing member) 110, removes the cartridge 101 without containing toner T from a formed opening portion 666, inserts a new cartridge 101, and closes the cartridge door 110 to replace the cartridge 101. At this time, there is a risk in which the cartridge 101 remains, in the course of loading processing, in a position along the way to the image forming position where image forming processing is executable. The cartridge 101 is, therefore, pressed by relay members (sandwiched unit) 127*a* and 127*b* arranged on the cartridge door 110 and urged to the image forming position of the apparatus main body A. A configuration of urging the cartridge 101 with the relay members 127*a* and 127*b* will be specifically described.

Figure 4A:
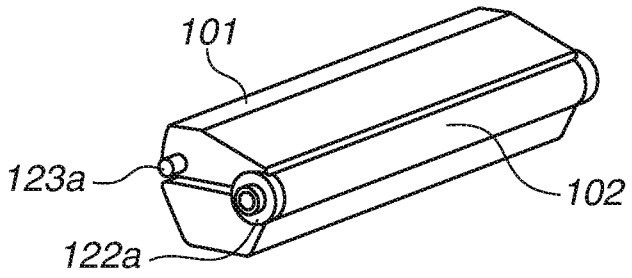
FIGS. 4A, 4B, and 4C are perspective diagrams of the cartridge according to the first exemplary embodiment.
Figure 4B:
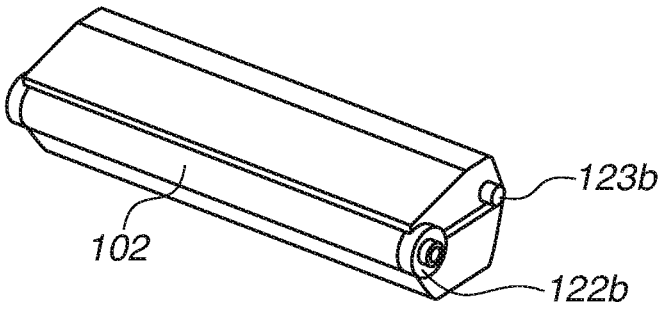
Figure 4C:
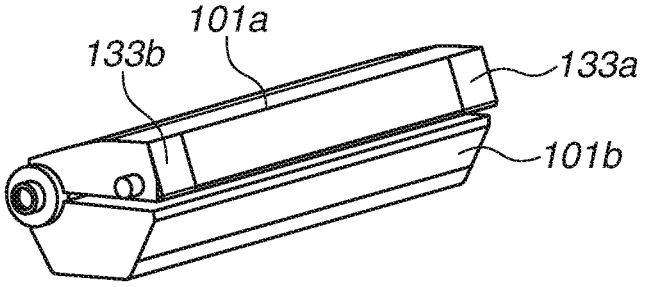

As illustrated in FIGS. 4A, 4B, and 4C, the cartridge 101 includes positioning portions (first portions) 122*a* and 122*b* for enabling the photosensitive drum 102 to be positioned at a position where image forming processing is executable, at both ends in the axis line direction of the photosensitive drum 102. Each of the positioning portions 122*a* and 122*b* is formed into a cylindrical shape having an axis that is the same as the axis of the photosensitive drum 102. In addition, in order to prevent the cartridge 101 from rotating by making the positioning portions 122*a* and 122*b* as the rotation center, the cartridge 101 includes rotation stopper portions 123*a* and 123*b*. In the present exemplary embodiment, although the rotation stopper portions 123*a* and 123*b* are arranged at both ends of the cartridge 101 in the axis line direction of the photosensitive drum 102, the cartridge 101 may include at least any one of the rotation stopper portions 123*a* and 123*b*.

Figure 3:
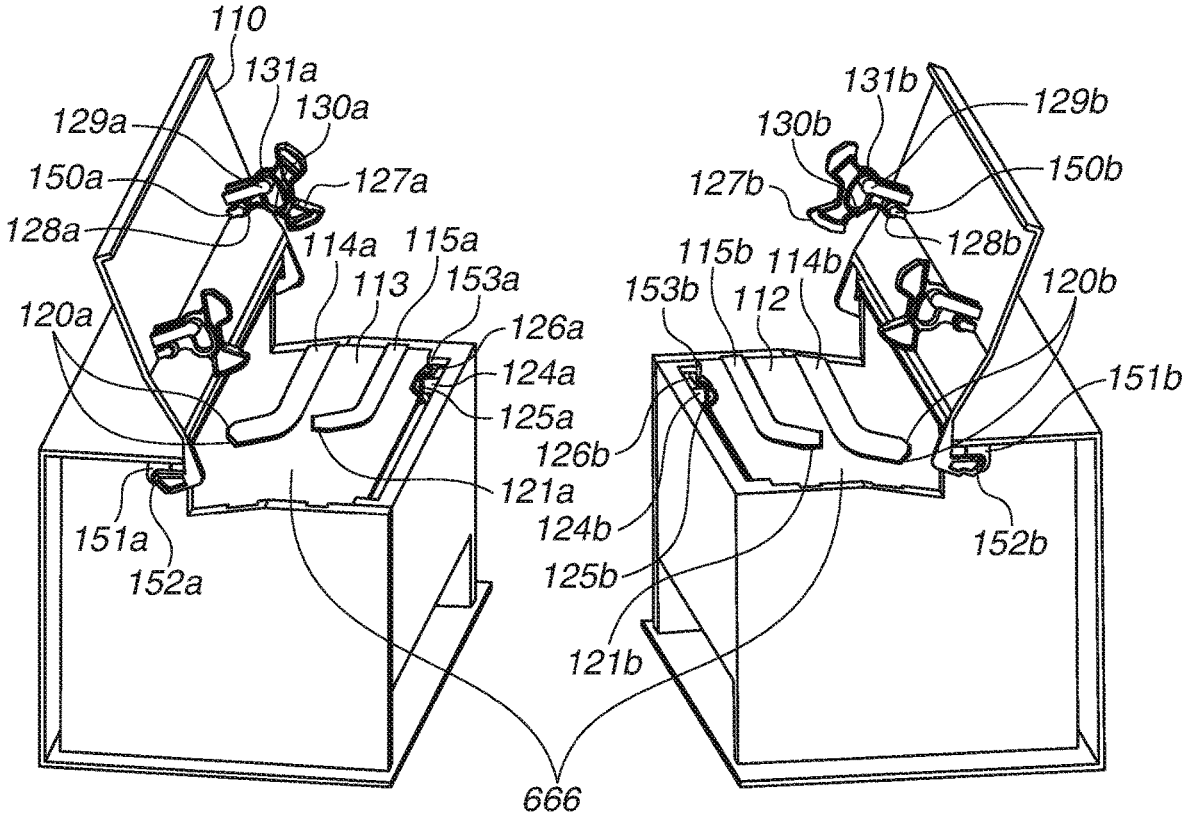
FIG. 3 is a perspective diagram of the image forming apparatus according to the first exemplary embodiment.

On the other hand, as illustrated in FIG. 3, a side plate 113 of the apparatus main body A has guides 114*a* and 115*a* which guide the cartridge 101 when the cartridge 101 is to be attached or detached. Similarly, a side plate 112 has guides 114*b* and 115*b* which guide the cartridge 101 when the cartridge 101 is to be attached or detached. The cartridge 101 can be positioned at a position where image formation is executable, by the guides 114*a*, 114*b*, 115*a*, and 115*b*.

The guide 114*a* guides the positioning portion 122*a* of the cartridge 101 to make the positioning portion 122*a* abut on an abutting portion 120*a* to position the cartridge 101. Similarly, the guide 114*b* guides the positioning portion 122*b* of the cartridge 101 to make the positioning portion 122*b* abut on an abutting portion 120*b* to position the cartridge 101.

Then, the guide 115*a* guides the rotation stopper portion 123*a* of the cartridge 101 to make the rotation stopper portion 123*a* abut on a rotation regulation portion 121*a* of the guide 115*a* to regulate rotation of the cartridge 101. Similarly, the guide 115*b* guides the rotation stopper portion 123*b* of the cartridge 101 to make the rotation stopper portion 123*b* abut on a rotation regulation portion 121*b* of the guide 115*b* to regulate rotation of the cartridge 101.

Door rotation shafts 152*a* and 152*b* of the cartridge door 110 respectively are held by shaft bearings 151*a* and 151*b* of the apparatus main body A, so that the cartridge door 110 can rotate to open or close the opening portion 666 through which the cartridge 101 enters an inner space of the apparatus main body A. The cartridge 110 passes through the opening portion 666 when the cartridge 110 is mounted on the apparatus main body A. In the present exemplary embodiment, the relay members 127*a* and 127*b* are arranged on a face of the cartridge door 110 which faces the abutting portion 120*b* or a space inside the apparatus main body A where the cartridge 101 enters. The relay member 127*a* is arranged on one end of the cartridge door 110 in the lengthwise direction. The relay member 127*b* is arranged on another end of the cartridge door 110 in the lengthwise direction and has a configuration similar to the relay member 127*a*. Hereinafter, a configuration relating to the relay member 127*a* and a periphery of the relay member 127*a* will therefore be described in detail, and description with respect to a configuration relating to the relay member 127*b* and a periphery of the relay member 127*b* will be omitted. Description and illustration will be provided while a symbol "a" is added to the reference numeral with respect to the configuration relating to the relay member 127*a* whereas a symbol "b" is added to the reference numeral with respect to the configuration relating to the relay member 127*b*.

A shaft 150*a* extending in parallel with the door rotation shafts 152*a* and 152*b* is arranged on a face of the cartridge door 110 which faces the space inside the apparatus main body A where the cartridge 101 enters, and a shaft bearing portion that engages with the shaft 150*a* is arranged on the relay member 127*a*. With this configuration, the relay member 127*a* can be rotationally moved by making the shaft 150*a* as a center. In other words, the relay member 127*a* can be moved with respect to the cartridge door 110. The relay member 127*a* has a rotation regulation hole, and a rotation regulation boss 129*a* arranged on the cartridge door 110 can move inside the rotation regulation hole. Thereby, an angle at which the relay member 127*a* can move rotationally is regulated. A pressing face 141*a* and a pressed face 142*a* are arranged on the relay member 127*a* in the order from a side of the rotation center of the cartridge door 110.

A pressing lever 125*a* held by the apparatus main body A in a rotationally movable state and a pressing spring 124*a* serving as an elastic member for urging the pressing lever 125*a*, which is arranged in a space between a main body frame 100 of the apparatus main body A and the pressing lever 125*a*, are arranged on the apparatus main body A. The pressing lever 125*a* is capable of being in contact with the pressed face 142*a*, and when the pressing lever 125*a* is in contact with the pressed face 142*a* to urge the pressed face 142*a*, the urging force is transmitted to the pressed face 133*a* of the cartridge 101 via the pressing face 141*a*, so that the cartridge 101 is inserted to the image forming position. The pressing lever 125*a* includes a temporary retaining portion 126*a* which engages with a temporary retained portion 153*a* arranged on the main body frame 100 of the apparatus main body A. As described above, the position of the pressing lever 125*a* urged by the pressing spring 124*a* can be regulated.

A pressing lever 125*b* having a configuration similar to that of the pressing lever 125*a* and a pressing spring 124*b* for urging the pressing lever 125*b* are arranged on the apparatus main body A. With this configuration, the urging force of the pressing spring 124*b* is transmitted to the cartridge 101 via the pressing lever 125*b* and the relay member 127*b*, so that the cartridge 101 is inserted to the image forming position.

<Attachment of Cartridge to Image Forming Apparatus>

Next, with reference to FIGS. 5 to 9, an operation of urging and inserting the cartridge 101 to the image forming position by the relay member 127*a* after the user opens the cartridge door 110 to insert the cartridge 101 from the formed opening portion 666 will be sequentially described. Herein, only a configuration of the drive side will be described. However, a configuration and an operation of the non-drive side are similar to those of the drive side unless otherwise specifically described.

Figure 5:
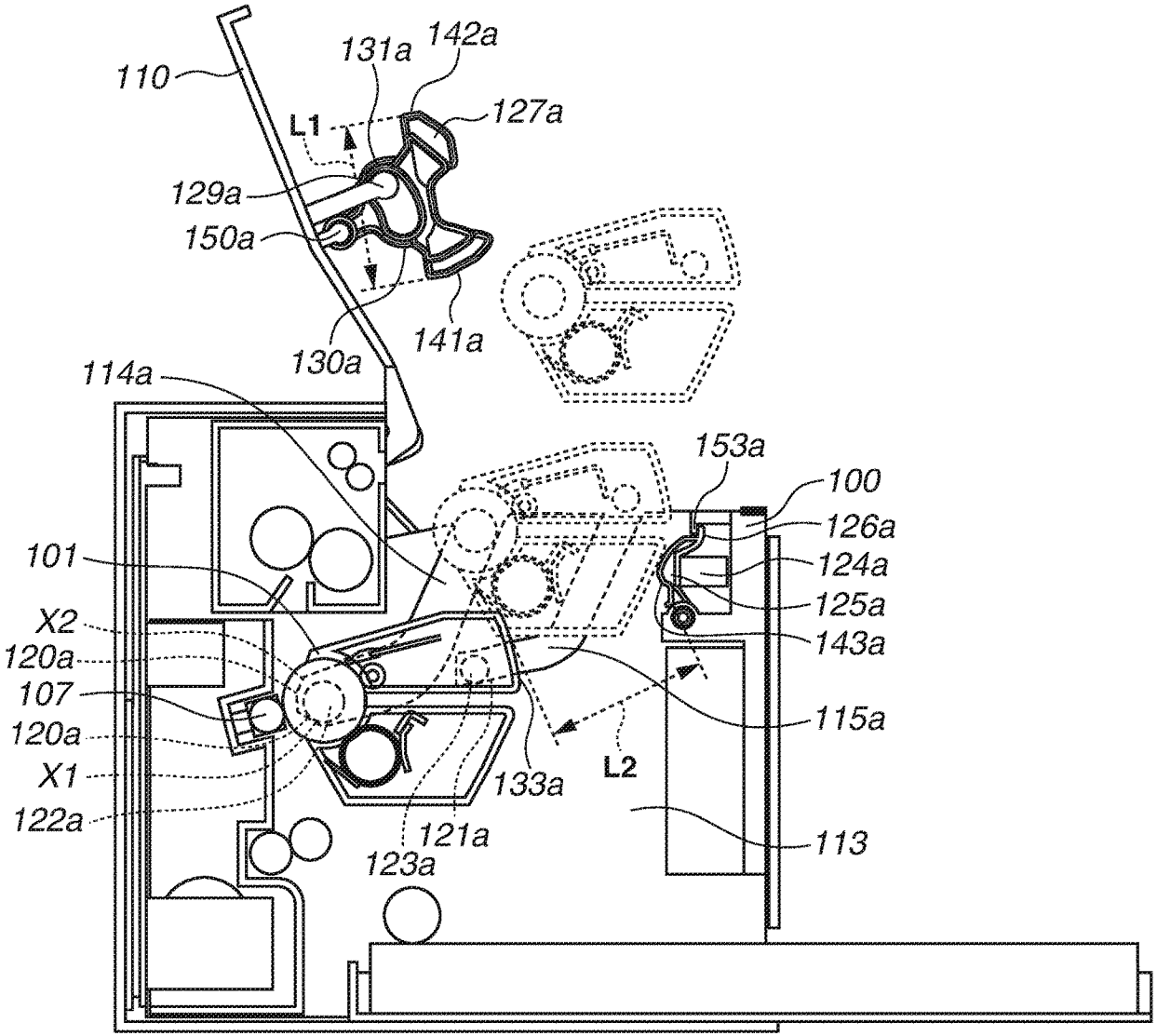
FIG. 5 is a diagram illustrating the apparatus main body of the image forming apparatus and an insertion/removal track and positioning of the cartridge according to the first exemplary embodiment.

The user opens the cartridge door 110 and inserts the cartridge 101 to make the positioning portion 122*a* and the rotation stopper portion 123*a* of the cartridge 101 respectively held by the guides 114*a* and 115*a* of the apparatus main body A. An orientation of the cartridge 101 is determined when the cartridge 101 is held by the two guides 114*a* and 115*a*, and the cartridge 101 is moved according to the shapes of the guides 114*a* and 115*a*. Accordingly, the cartridge 101 is moved while following a cartridge insertion/removal (attachment/detachment) track as illustrated in FIG. 5. At this time, the pressing lever 125*a* is held by the apparatus main body A at a position outside the insertion/removal track of the cartridge 101. When the cartridge door 110 is opened, the relay member 127*a* is held at a position (second position) outside the insertion/removal track of the cartridge 101 in an orientation in which the rotation regulation boss 129*a* is in contact with a regulation face 131*a* of the rotation regulation hole because of the gravitational force.

Figure 6:
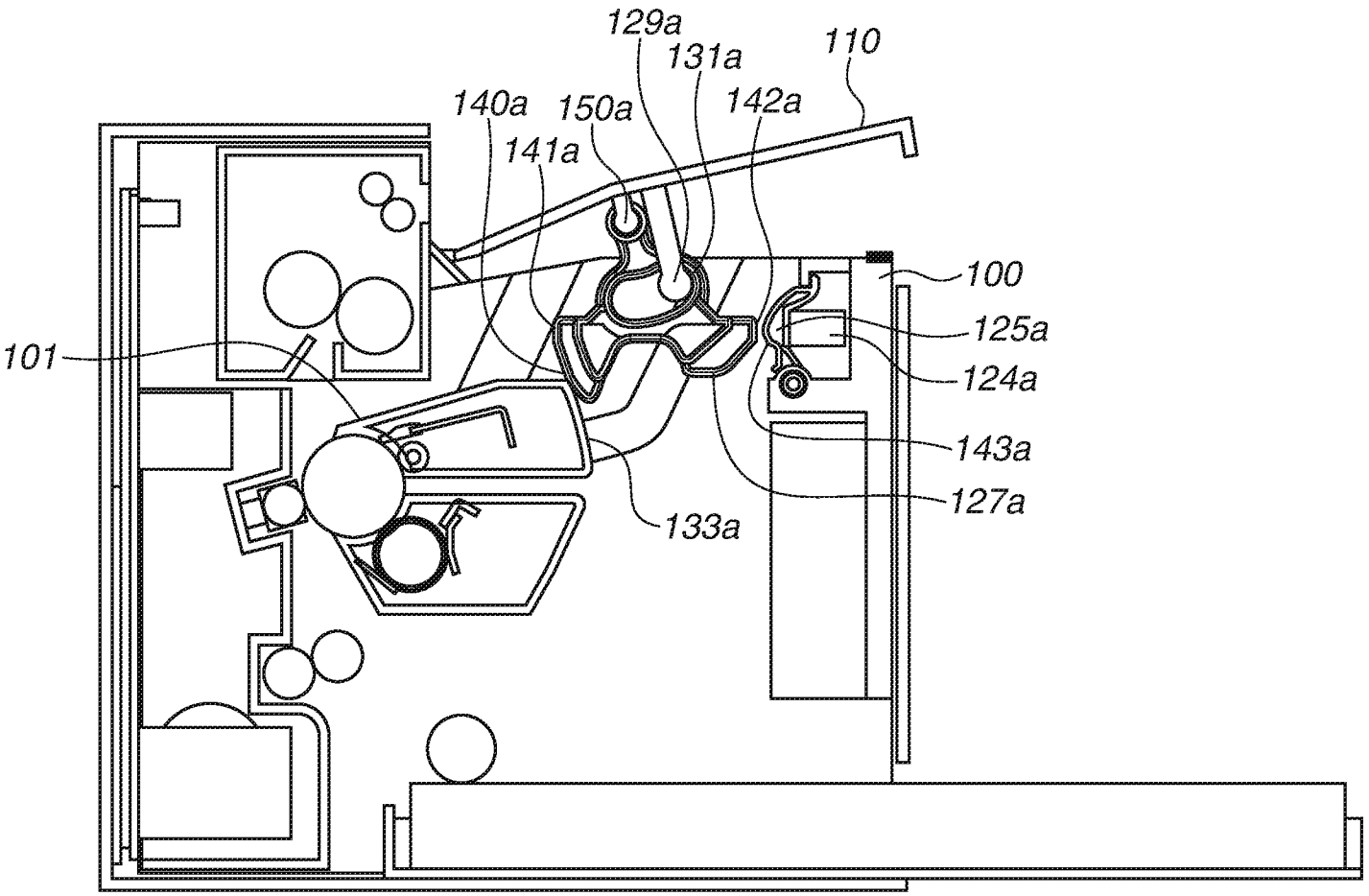
FIG. 6 is a cross-sectional diagram of the apparatus main body and the cartridge, which illustrates a state where a cartridge door of the image forming apparatus according to the first exemplary embodiment is opened or closed halfway.
Figure 7:
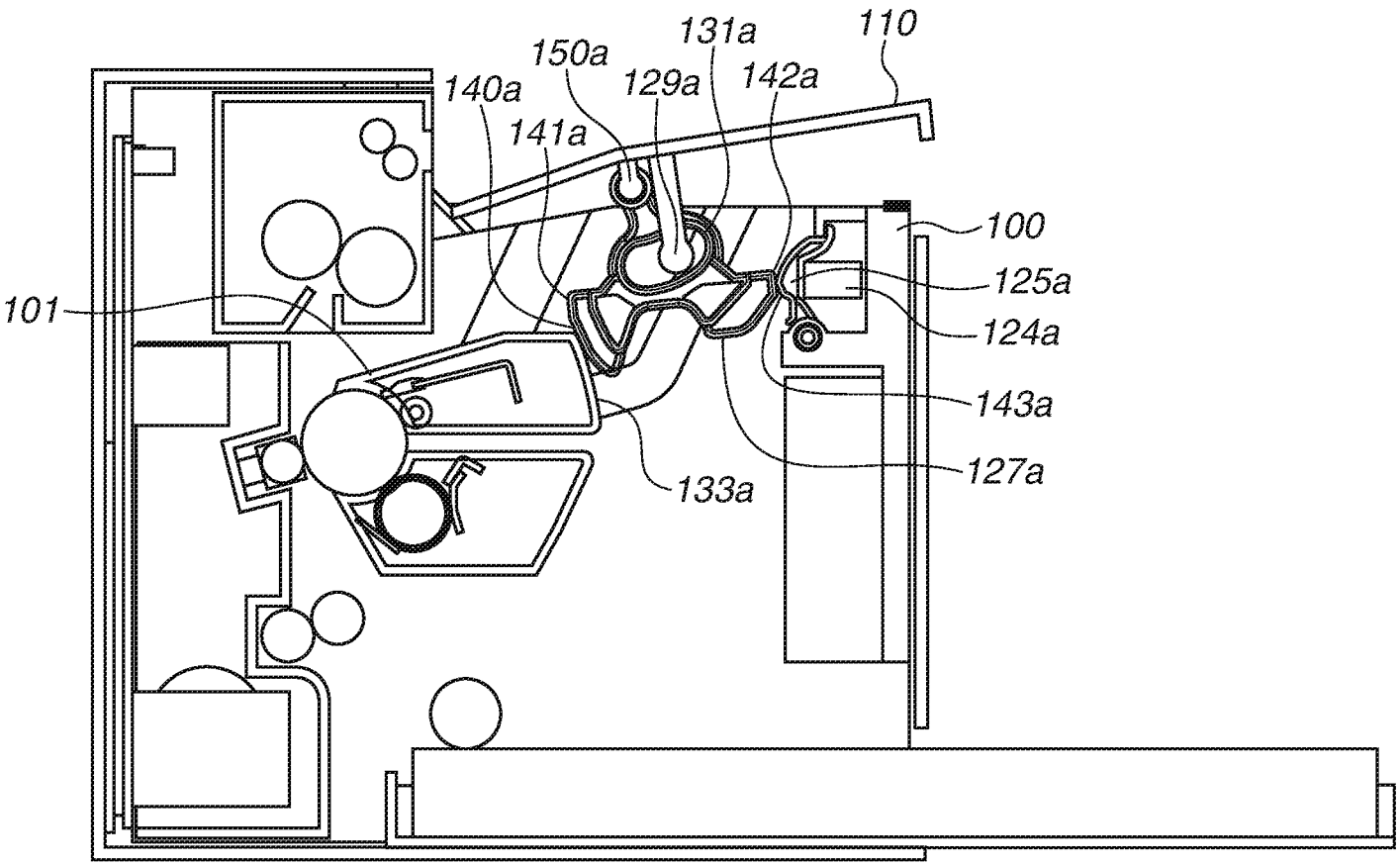
FIG. 7 is a cross-sectional diagram of the apparatus main body and the cartridge, which illustrates a state where the cartridge door of the image forming apparatus according to the first exemplary embodiment is further closed than in the state in FIG. 6.

As illustrated in FIG. 6, when the user inserts the cartridge 101 to the apparatus main body A and executes a closing operation of the cartridge door 110 to move the cartridge door 110 from the opening position to the closing position, the pressing face 141*a* of the relay member 127*a* is in contact with the pressed face 133*a* of the cartridge 101. When the closing operation of the cartridge door 110 is further executed, the rotation regulation boss 129*a* is separated from the regulation face 131*a* of the rotation regulation hole to move along the inner surface of the rotation regulation hole, so that the relay member 127*a* is rotated. Then, when the closing operation is further executed, the pressed face 142*a* of the relay member 127*a* is in contact with the pressing lever 125*a* while the pressing face 141*a* of the relay member 127*a* is in contact with the pressed face 133*a* of the cartridge 101 (see FIG. 7). By further executing the closing operation of the cartridge door 110 in the above state, the cartridge door 110 is eventually moved to the closing position (see FIG. 8). As illustrated in FIG. 5, a distance L1 between the pressing face 141*a* and the pressed face 142*a* of the relay member 127*a* is longer than a distance L2 between the pressed face 133*a* of the cartridge 101 and the pressing face (second portion) 143*a* of the pressing lever 125*a*. Therefore, when the cartridge 101 is urged by the relay member 127*a*, a position of the cartridge 101 is regulated by the abutting portion 120*a* of the apparatus main body A. The pressing face 143*a* of the pressing lever 125*a* is arranged on the opposite side of the positioning portion 122*a* with respect to the photosensitive drum 102 in a direction intersecting with the rotation axis line of the photosensitive drum 102.

On the other hand, when the pressing lever 125*a* is urged by the relay member 127*a*, the pressing lever 125*a* compresses and deforms the pressing spring 124*a* to rotationally move. As described above, the temporary retaining portion 126*a* of the pressing lever 125*a* is separated from the temporary retained portion 153*a* arranged on the main body frame 100 of the apparatus main body A. As a result, the urging force of the pressing spring 124*a* is transmitted to the cartridge 101 via the pressing lever 125*a*. As described above, when the cartridge door 110 is located at the closing position, the relay member 127*a* is located at a position (first position) where the relay member 127*a* is held between the pressed face 133*a* of the cartridge 101 (drum unit 101*a*) and the pressing face 143*a* of the pressing lever 125*a*. The relay member 127*a* urges the cartridge 101 at the first position to make the cartridge 101 abut on the abutting portion 120*a* of the apparatus main body A, so that the position of the cartridge 101 with respect to the apparatus main body A is determined.

In the present exemplary embodiment, the abutting portion 120*a* is formed into a V-shape consisting of inclined planes X1 and X2. When the cartridge door 110 is located at the opening position, and the relay member 127*a* is located outside the insertion/removal track of the cartridge 101, the positioning portion 122*a* is not in contact with the inclined plane X2 of the abutting portion 120*a* of the apparatus main body A due to the own weight of the cartridge 101 and the pressing of the transfer roller 107. However, when the cartridge 101 is urged by the relay member 127*a*, the positioning portion 122*a* of the cartridge 101 (drum unit 101*a*) moves on the inclined plane X1 due to the pressing force of the pressing spring 124*a* until the positioning portion 122*a* is in contact with the inclined plane X2 of the abutting portion 120*a*. As a result, movement of the positioning portion 122*a* of the cartridge 101 is stopped in a state where the positioning portion 122*a* is in contact with both of the inclined planes X1 and X2, so that the photosensitive drum 102 can be placed at a position where image forming processing is executable.

In the present exemplary embodiment, a contact face between the pressing face 142*a* of the relay member 127*a* and the pressing face 143*a* of the pressing lever 125*a* and a contact face between the pressing face 141*a* of the relay member 127*a* and the pressed face 133*a* of the cartridge 101 are aligned in a straight line. Then, a vector Q of the pressing force generated by the pressing spring 124*a* extends along the straight line toward the center of the photosensitive drum 102, and passes through a position between the inclined planes X1 and X2 of the V-shaped abutting portion 120*a*. In the present exemplary embodiment, the cartridge 101 can therefore be stably held. On the other hand, because the shaft 150*a* of the relay member 127*a* is not located at a position in the straight line along which the vector Q extends, the relay member 127*a* is rotated to transmit a driving force to the cartridge 101. As described above, the photosensitive drum 102 is positioned at a position where image forming processing is executable, so that a position of the cartridge 101 can be stably retained.

<Detachment of Cartridge from Image Forming Apparatus>

Figure 8:
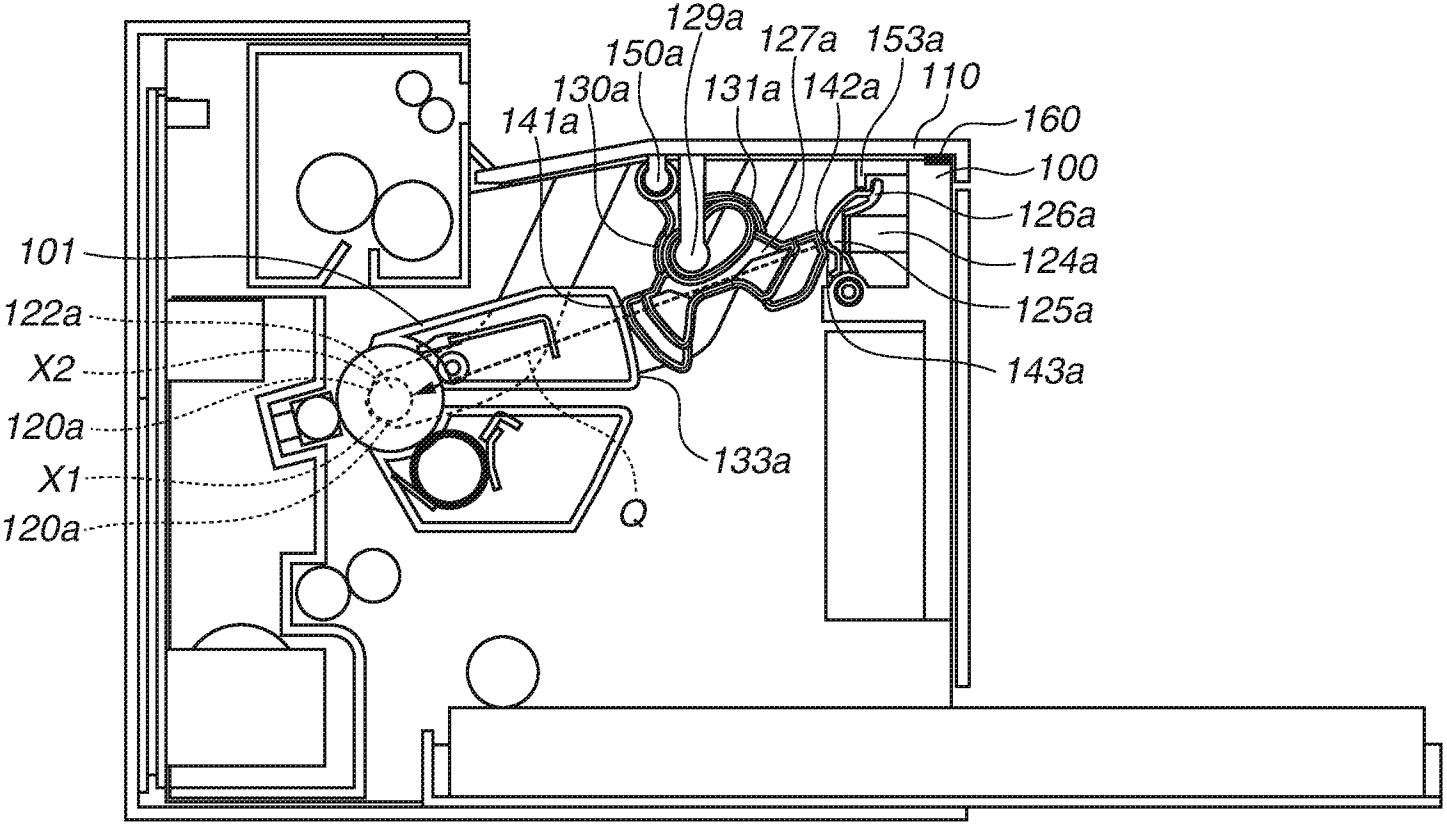
FIG. 8 is a cross-sectional diagram of the apparatus main body and the cartridge, which illustrates a state where the cartridge door of the image forming apparatus according to the first exemplary embodiment is closed.

A configuration for taking out the cartridge 101 from the apparatus main body A will be described. Herein, only a configuration of the drive side will be described. However, a configuration and an operation of the non-drive side are similar to those of the drive side unless otherwise specifically described. An operation opposite to the above-described operation of inserting the cartridge 101 will be executed as an operation of taking out the cartridge 101 from the apparatus main body A. In other words, an opening operation of the cartridge door 110 is executed in a state where the cartridge 101 is located at an image forming position, while the relay member 127*a* is in contact with both of the cartridge 101 and the pressing lever 125*a* as illustrated in FIG. 8. When the opening operation of the cartridge door 110 is executed, the relay member 127*a* is separated from the pressing lever 125*a* (see FIG. 7). Then, the relay member 127*a* is separated from the cartridge 101, so that the rotation regulation boss 129*a* is eventually brought into contact with the regulation face 131*a* of the rotation regulation hole. Then, when the cartridge door 110 is located at the opening position, the relay member 127*a* is moved to a position outside the insertion/removal track of the cartridge 101, as illustrated in FIG. 5.

Accordingly, the cartridge 101 can be taken out from the inner portion of the apparatus main body A without being in contact with the relay member 127*a* and the pressing lever 125*a* that press and hold the cartridge 101. Specifically, in the present exemplary embodiment, the relay member 127*a* is inserted in a direction intersecting with the pressing direction of the cartridge 101. Thus, although the cartridge 101 is urged by elastically deforming the elastic member through the closing operation of the cartridge door 110, it is possible to reduce a strength necessary for the replacement work of the cartridge 101. Further, in the present exemplary embodiment, the pressed face 133*a* of the cartridge 101 which is in contact with the relay member 127*a* is formed into an arc-like shape having the rotation center that is the same as the rotation center of the photosensitive drum 102. With this configuration, a force for operating the cartridge door 110 can be further reduced. As described above, the cartridge 101 can be stably held in the apparatus main body A at the time of image formation, and a strength necessary for replacing the cartridge 101 is reduced. Usability thereof can therefore be improved.

In the first exemplary embodiment, the relay members 127*a* and 127*b* move rotationally. However, the configuration is not limited thereto, and the relay member may move in a sliding manner. Therefore, as a second exemplary embodiment, a relay member that moves in a sliding manner will be described. In addition, a reference numeral that is the same as the reference numeral in the first exemplary embodiment is applied to a configuration similar to that of the first exemplary embodiment, and description thereof will be omitted. Herein, only a configuration of the drive side will be described. However, a configuration and an operation of the non-drive side are similar to those of the drive side unless otherwise specifically described.

<Configuration for Pressing Cartridge>

Similar to the first exemplary embodiment, a cartridge door 210 is held by a shaft bearing of the apparatus main body A in a rotationally movable state, and a relay member 227*a* is arranged on a face of the cartridge door 210 which faces a space inside the apparatus main body A where the cartridge 101 enters. More specifically, supporting portions 211*a* and 212*a* are arranged on a face of the cartridge door 210 which faces a space inside the apparatus main body A where the cartridge 101 enters. Then, the relay member 227*a* includes an elongate hole 240*a*, and the supporting portions 211*a* and 212*a* are arranged to engage with an internal portion of the elongate hole 240*a*. With this configuration, the relay member 227*a* can move in a sliding manner in a direction intersecting with a rotation axis of the cartridge door 210 with respect to the supporting portions 211*a* and 212*a* as well as the cartridge door 210. Similar to the first exemplary embodiment, a pressing face 241*a* and a pressed face 242*a* are arranged on the relay member 227*a* in the order from a side of the rotation center of the cartridge door 210. The pressing lever 125*a* is capable of being in contact with the pressed face 242*a*, and when the pressing lever 125*a* is in contact with the pressed face 242*a* to urge the pressed face 242*a*, the urging force is transmitted to a pressed face 133*a* of the cartridge 101 via the pressing face 241*a*, so that the cartridge 101 is inserted to the image forming position.

<Attachment of Cartridge to Image Forming Apparatus>

Next, with reference to FIGS. 5 to 9, an operation of urging and inserting the cartridge 101 to the image forming position by the relay member 227*a* after the user opens the cartridge door 210 to insert the cartridge 101 from the formed opening portion 666 will be sequentially described.

The user opens the cartridge door 210 and inserts the cartridge 101 to make the positioning portion 122*a* and the rotation stopper portion 123*a* of the cartridge 101 respectively held by the guides 114*a* and 115*a* of the apparatus main body A. An orientation of the cartridge 101 is determined when the cartridge 101 is held by the two guides 114*a* and 115*a*, and the cartridge 101 is moved according to the shapes of the guides 114*a* and 115*a*. Accordingly, the cartridge 101 is moved while following an insertion/removal track of the cartridge 101 as illustrated in FIG. 5. At this time, the pressing lever 125*a* is held by the apparatus main body A at a position outside the insertion/removal track of the cartridge 101. When the cartridge door 210 is opened, the relay member 227*a* is held at a position outside the insertion/removal track of the cartridge 101 in an orientation in which the supporting portion 211*a* is in contact with a regulation face 231*a* of the elongate hole 240*a* because of the gravitational force. As a result, insertion or removal of the cartridge 101 will not be interrupted because the relay member 227*a* is located at a position outside the insertion/removal track of the cartridge 101. Accordingly, when the cartridge 101 is to be inserted, the cartridge 101 can be inserted to the apparatus main body A without being in contact with the pressing lever 125*a* or the relay member 227*a* that presses the cartridge 101.

Figure 9:
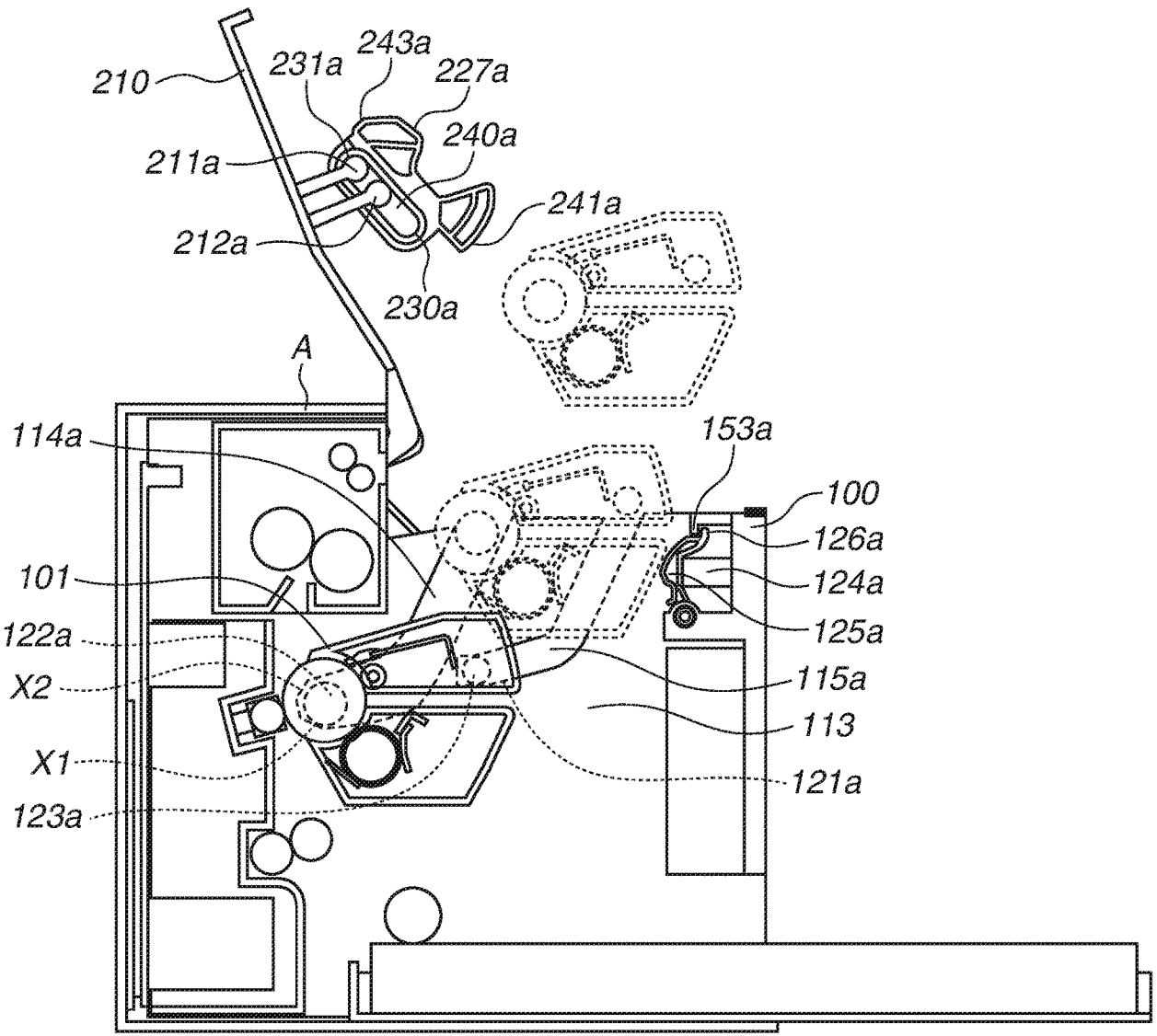
FIG. 9 is a diagram illustrating an apparatus main body of an image forming apparatus and an insertion/removal track and positioning of a cartridge according to a second exemplary embodiment.
Figure 11:
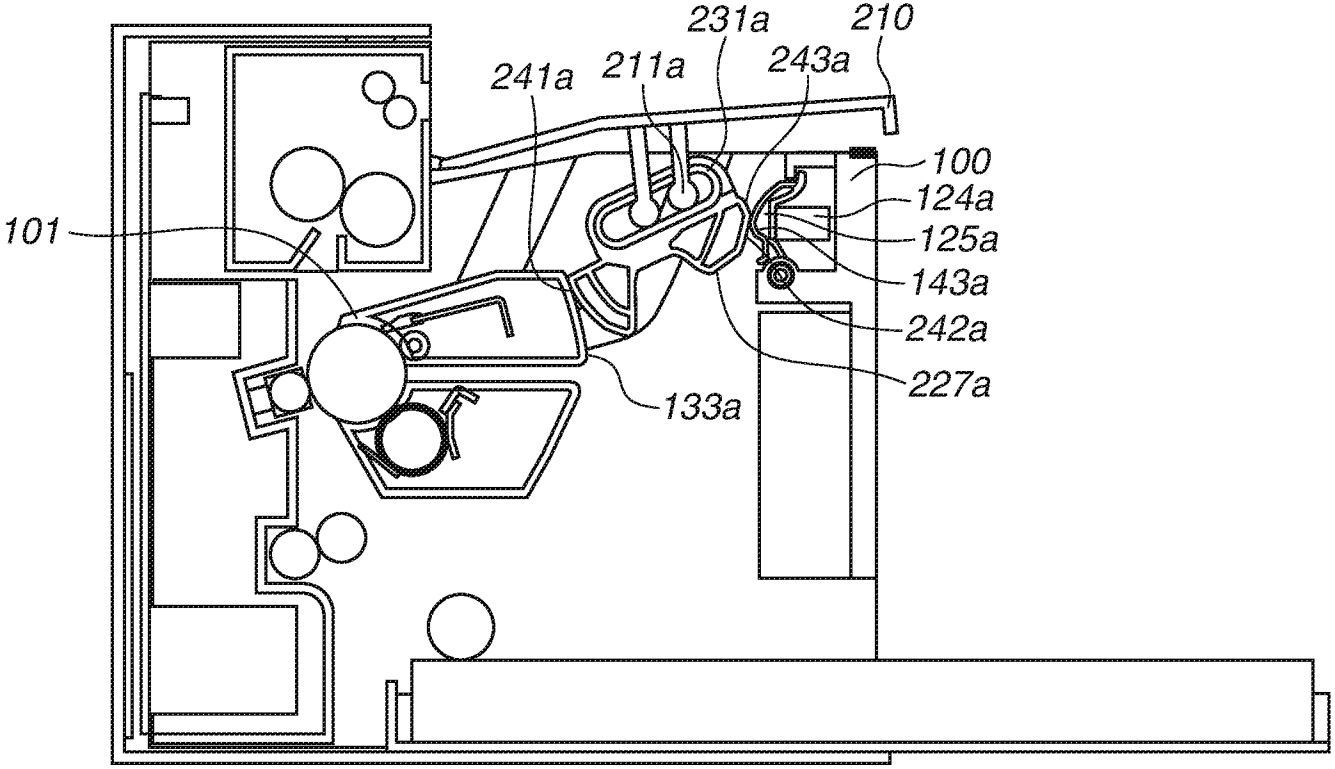
FIG. 11 is a cross-sectional diagram of the apparatus main body and the cartridge, which illustrates a state where the cartridge door of the image forming apparatus according to the second exemplary embodiment is further closed than in the state in FIG. 10.

As illustrated in FIG. 9, when the user inserts the cartridge 101 to the apparatus main body A and executes a closing operation of the cartridge door 210 to move the cartridge door 210 from the opening position to the closing position, the pressing face 241*a* of the relay member 227*a* is in contact with the pressed face 133*a* of the cartridge 101. When the closing operation of the cartridge door 210 is further executed, the relay member 227*a* starts moving in a sliding manner with respect to the cartridge door 210, and the supporting portion 211*a* is separated from the regulation face 231*a* of the elongate hole 240*a*. Then, when the closing operation is further executed, the pressed face 242*a* of the relay member 227*a* is in contact with the pressing lever 125*a* while the pressing face 241*a* of the relay member 227*a* is in contact with the pressed face 133*a* of the cartridge 101 (see FIG. 11). By further executing the closing operation of the cartridge door 210 in the above state, the cartridge door 210 is eventually moved to the closing position (see FIG. 12).

<Detachment of Cartridge from Image Forming Apparatus>

Figure 10:
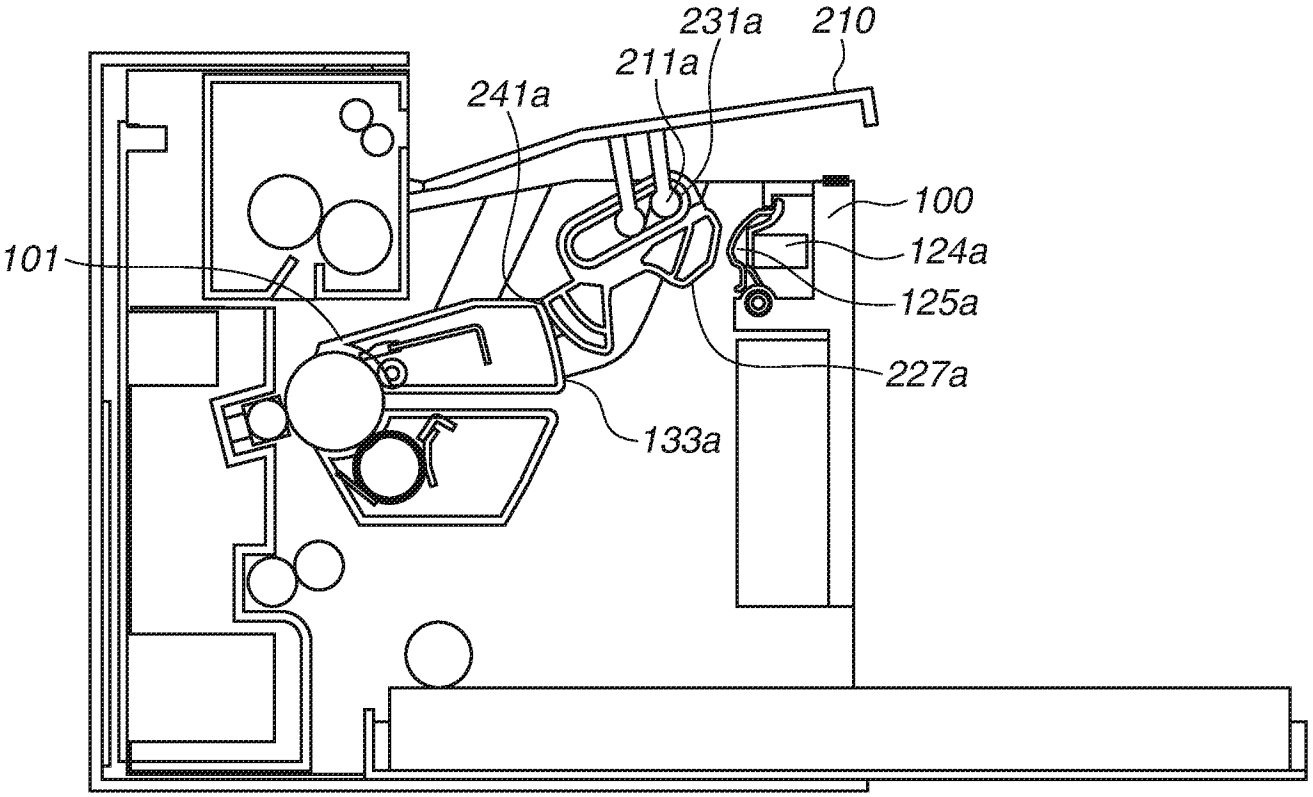
FIG. 10 is a cross-sectional diagram of the apparatus main body and the cartridge, which illustrates a state where a cartridge door of the image forming apparatus according to the second exemplary embodiment is opened or closed halfway.
Figure 12:
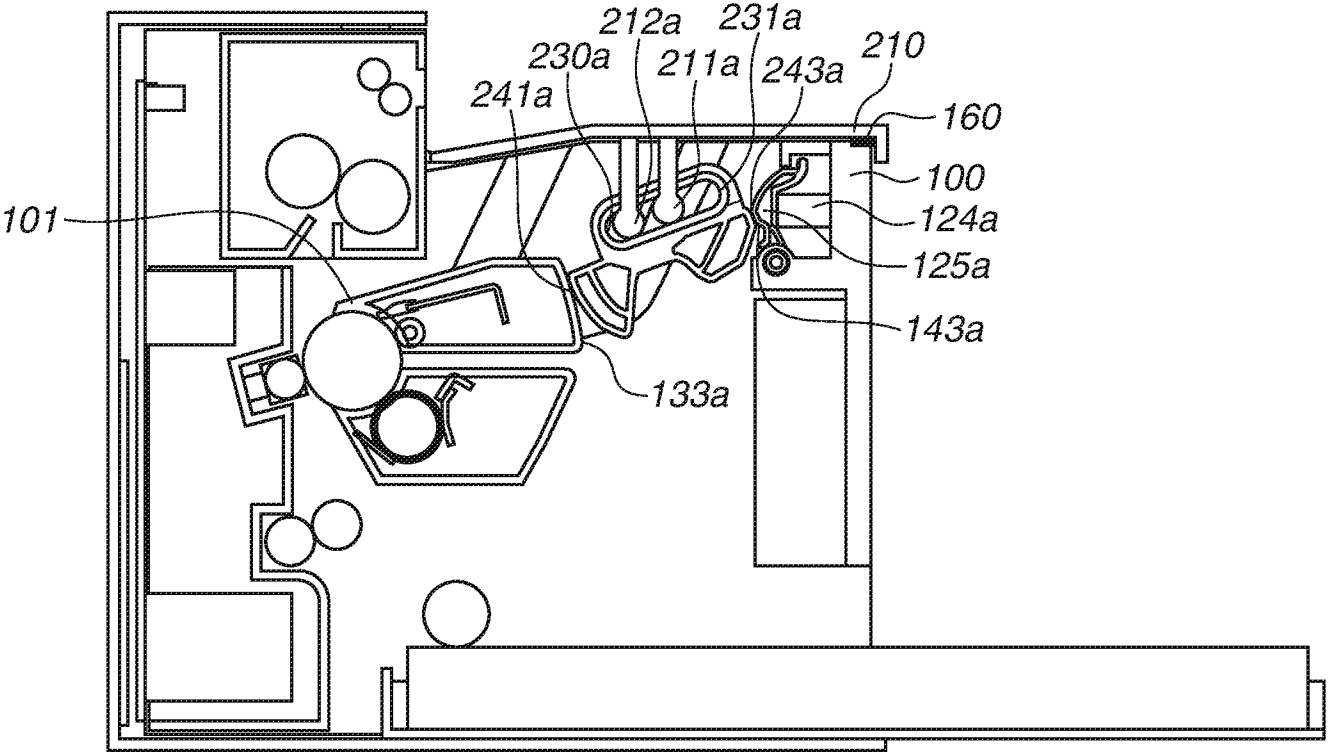
FIG. 12 is a cross-sectional diagram of the apparatus main body and the cartridge, which illustrates a state where the cartridge door of the image forming apparatus according to the second exemplary embodiment is closed.

A configuration for taking out the cartridge 101 from the apparatus main body A will be described. An operation opposite to the above-described operation of inserting the cartridge 101 will be executed as an operation of taking out the cartridge 101 from the apparatus main body A. In other words, an opening operation of the cartridge door 210 is executed in a state where the cartridge 101 is located at an image forming position, and the relay member 227*a* is in contact with both of the cartridge 101 and the pressing lever 125*a* as illustrated in FIG. 12. When the opening operation of the cartridge door 210 is executed, the relay member 227*a* is separated from the pressing lever 125*a* (see FIG. 10). Then, the relay member 227*a* is separated from the cartridge 101, so that the supporting portion 211*a* is eventually brought into contact with the regulation face 131*a* of the elongate hole 240*a*. Then, when the cartridge door 210 is located at the opening position, the relay member 227*a* is moved to a position outside the insertion/removal track of the cartridge 101 as illustrated in FIG. 9.

Accordingly, the cartridge 101 can be taken out from the inner portion of the apparatus main body A without being in contact with the relay member 227*a* and the pressing lever 125*a* that press and hold the cartridge 101. Specifically, in the present exemplary embodiment, the relay member 227*a* is inserted in a direction intersecting with the pressing direction of the cartridge 101. Therefore, although the cartridge 101 is urged by elastically deforming the elastic member through the closing operation of the cartridge door 210, it is possible to reduce a strength necessary for the replacement work of the cartridge 101.

In the present exemplary embodiment, the two supporting portions 211*a* and 212*a* are located inside the elongate hole 240*a*, and the relay member 227*a* can move in a sliding manner by a predetermined width with respect to the cartridge door 210. However, a configuration in which the relay member 227*a* does not move rotationally with respect to the cartridge door 210 is not limited to the above. For example, one supporting portion formed into a substantially rectangular shape may be arranged inside the elongate hole 240*a*, so that the relay member 227*a* may slide with respect to the cartridge door 210 without moving rotationally.

In the first exemplary embodiment, the urging member is arranged on the apparatus main body, and an urging force generated by the urging member is applied to the cartridge via the relay member arranged on the cartridge door. However, the configuration is not limited thereto, and the elastic member may be arranged on the relay member. Therefore, as a third exemplary embodiment, a configuration of a relay member having an elastic member will be described. In addition, a reference numeral that is the same as the reference numeral in the first exemplary embodiment is applied to a configuration similar to that of the first exemplary embodiment, and description thereof will be omitted. Herein, only a configuration of the drive side will be described. However, a configuration and an operation of the non-drive side are similar to those of the drive side unless otherwise specifically described.

<Configuration for Pressing Cartridge>

Figure 17:
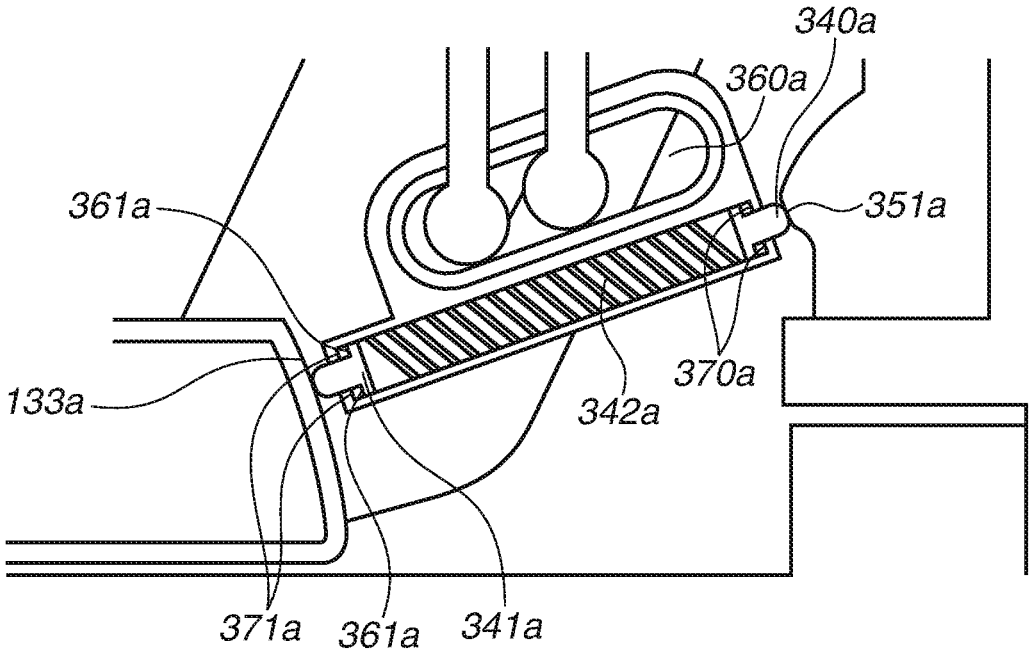
FIG. 17 is an enlarged cross-sectional diagram illustrating a state where the cartridge of the image forming apparatus according to the third exemplary embodiment is pressed.

Similar to the first exemplary embodiment, a cartridge door 310 is held by a shaft bearing of the apparatus main body A in a rotationally movable state, and a relay member 327*a* is arranged on a face of the cartridge door 310 which faces a space inside the apparatus main body A where the cartridge 101 enters. More specifically, supporting portions 311*a* and 312*a* are arranged on a face of the cartridge door 310 which faces a space inside the apparatus main body A where the cartridge 101 enters. Then, the relay member 327*a* includes an elongate hole 360*a*, and the supporting portions 311*a* and 312*a* are arranged to engage with an internal portion of the elongate hole 360*a*. With this configuration, the relay member 327*a* can move in a sliding manner with respect to the supporting portions 311*a* and 312*a* as well as the cartridge door 310. In the present exemplary embodiment, the relay member 327*a* includes a pressing spring 342*a* serving as an elastic member, and a pressing member 340*a* is arranged on one end of the pressing spring 342*a* positioned on a side of the rotation center of the cartridge door 101, whereas a pressing member 341*a* is arranged on another end thereof (see FIG. 17). With this configuration, the pressing spring 342*a* of the relay member 327*a* applies a certain spring pressure in a direction in which the pressing members 340*a* and 341*a* are separated from each other. Furthermore, the pressing members 340*a* and 341*a* of the relay member 327*a* respectively are held by retaining portions 370*a* and 371*a*, so that the pressing members 340*a* and 341*a* are prevented from coming off.

On the other hand, the pressing lever 125*a* and the pressing spring 124*a* serving as an elastic member for urging the pressing lever 125*a*, which are arranged on the apparatus main body A in the first exemplary embodiment, are not arranged thereon, and an inner wall face of the main body frame 100 of the apparatus main body A faces a space to which the cartridge 101 is to be inserted. With this configuration, the relay member 327*a* can be inserted between the cartridge 101 and the main body frame 100 of the apparatus main body A. In other words, the pressing member 340*a* located at one end of the pressing spring 342*a* can be in contact with a pressed portion 351*a* of the main body frame 100, whereas the pressing member 341*a* located at another end of the pressing spring 342*a* can be in contact with the pressed face 133*a* of the cartridge 101. As described above, the cartridge 101 is urged and inserted to the image forming position.

<Attachment of Cartridge to Image Forming Apparatus>

Next, with reference to FIGS. 13 to 18, an operation of urging and inserting the cartridge 101 to the image forming position by the relay member 327*a* after the user opens the cartridge door 310 to insert the cartridge 101 from the formed opening portion 666 will be sequentially described.

Figure 13:
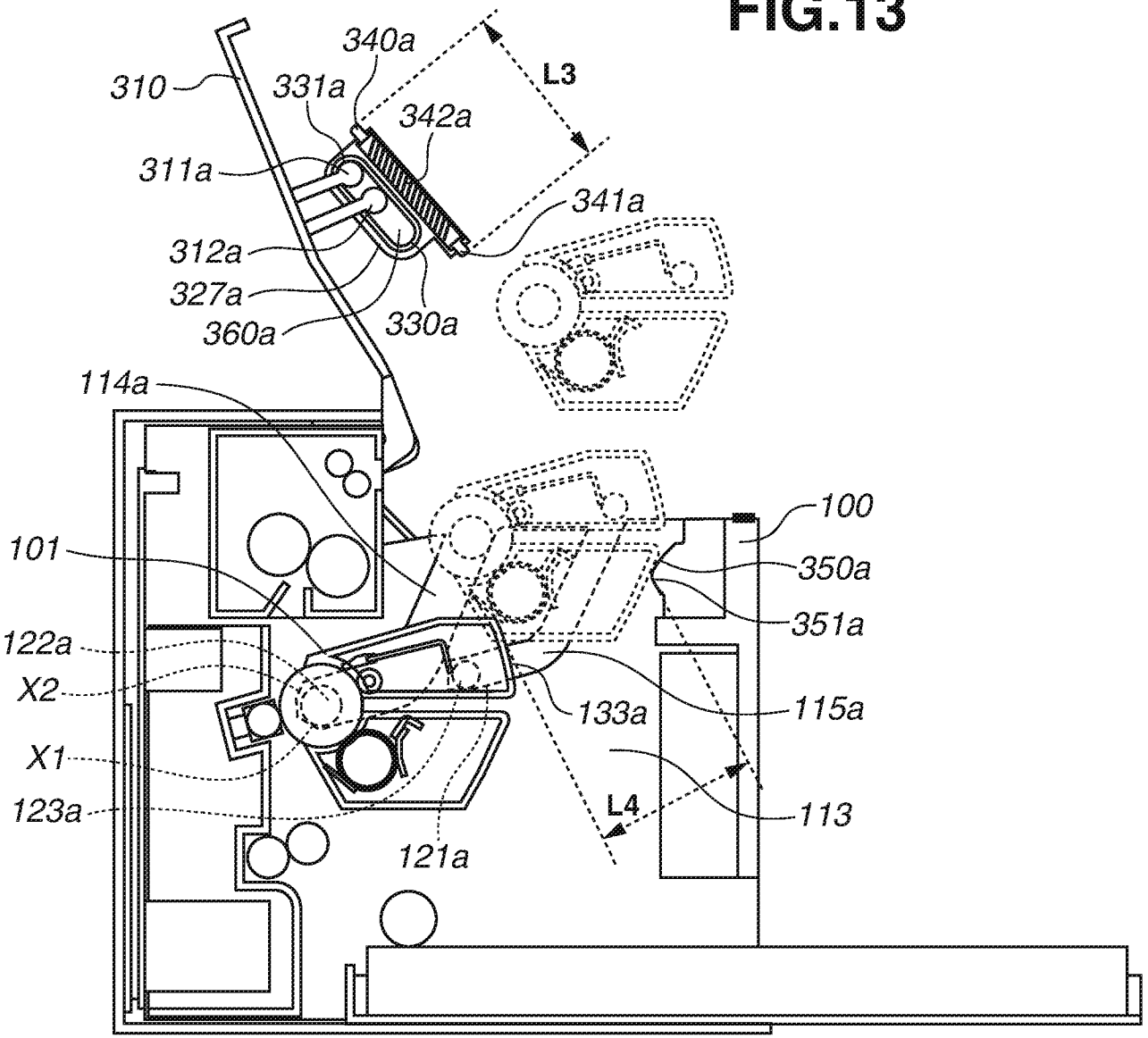
FIG. 13 is a diagram illustrating an apparatus main body of an image forming apparatus and an insertion/removal track and positioning of a cartridge according to a third exemplary embodiment.
Figure 14:
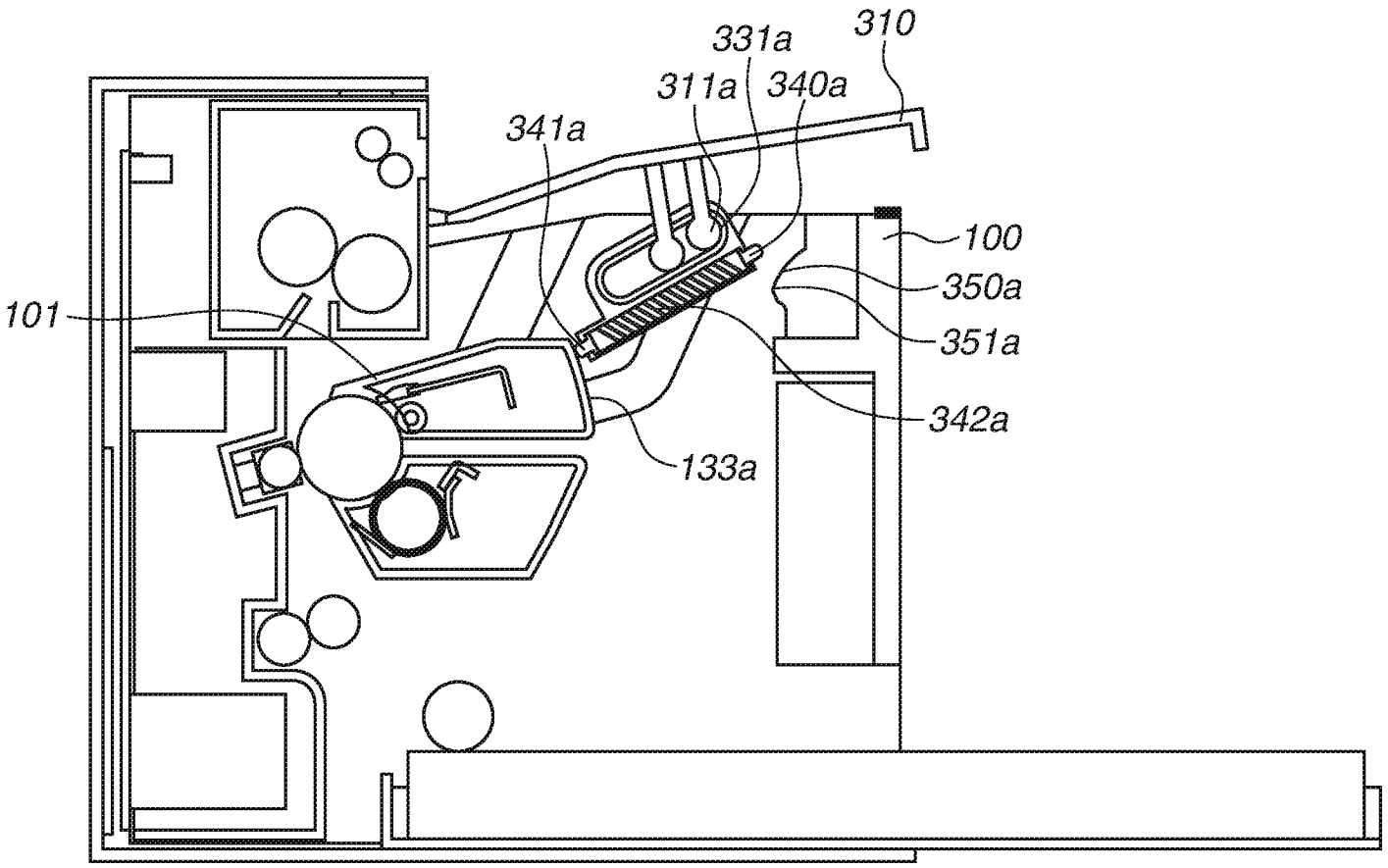
FIG. 14 is a cross-sectional diagram of the apparatus main body and the cartridge, which illustrates a state where a cartridge door of the image forming apparatus according to the third exemplary embodiment is opened or closed halfway.
Figure 15:
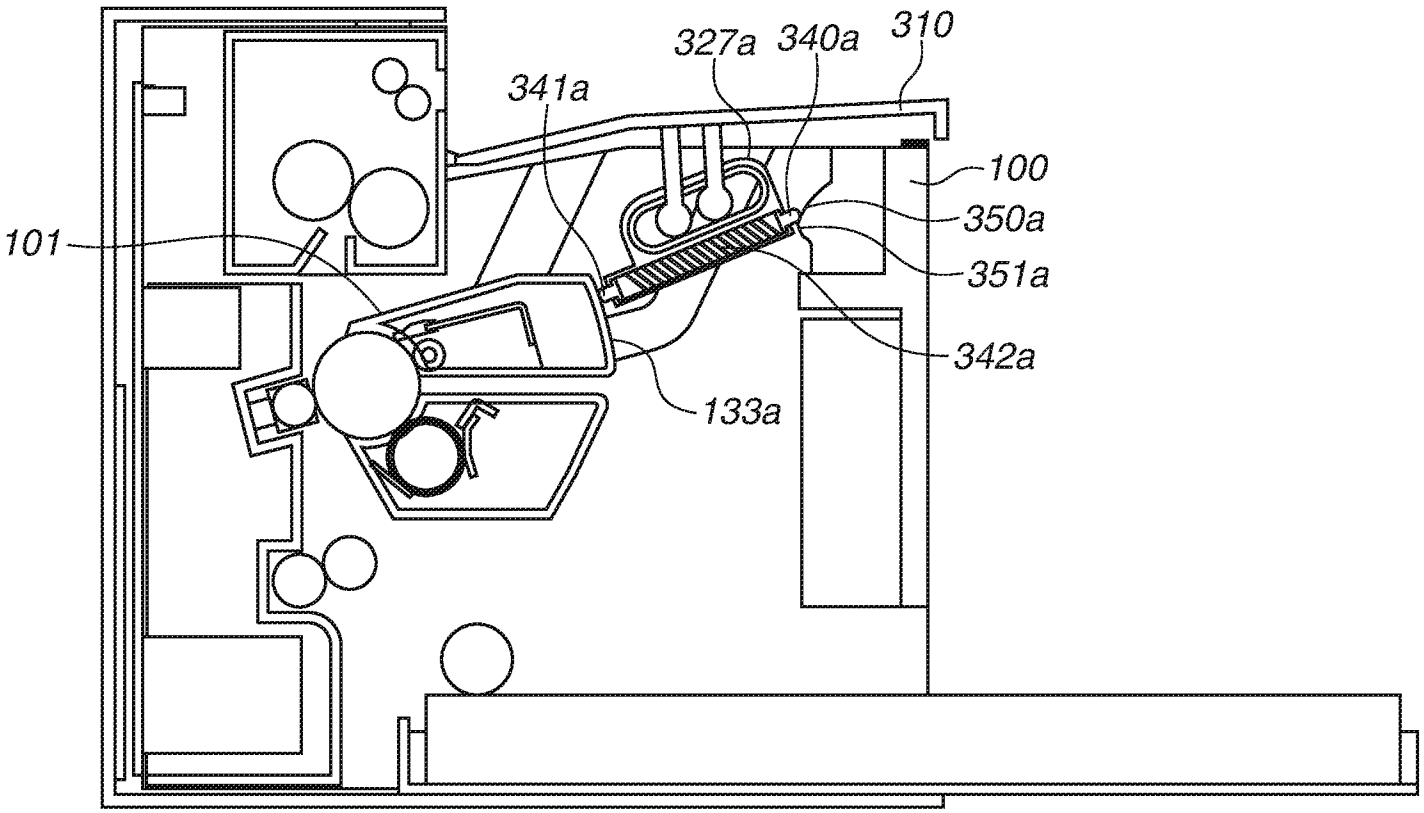
FIG. 15 is a cross-sectional diagram of the apparatus main body and the cartridge, which illustrates a state where the cartridge door of the image forming apparatus according to the third exemplary embodiment is further closed than in the state in FIG. 14.

The user opens the cartridge door 310 and inserts the cartridge 101 to make the positioning portion 122*a* and the rotation stopper portion 123*a* of the cartridge 101 respectively held by the guides 114*a* and 115*a* of the apparatus main body A. An orientation of the cartridge 101 is determined when the cartridge 101 is held by the two guides 114*a* and 115*a*, and the cartridge 101 is moved according to the shapes of the guides 114*a* and 115*a*. Accordingly, the cartridge 101 is moved while following an insertion/removal track of the cartridge 101 as illustrated in FIG. 13. When the cartridge door 310 is opened, the relay member 327*a* is held at a position outside the insertion/removal track of the cartridge 101 in an orientation in which the supporting portion 311*a* is in contact with a regulation face 331*a* of the elongate hole 360*a* because of the gravitational force.

As a result, an insertion or removal of the cartridge 101 will not be interrupted because the relay member 327*a* is located at a position outside the insertion/removal track of the cartridge 101. Accordingly, when the cartridge 101 is to be inserted, the cartridge 101 can be inserted into the apparatus main body A without being in contact with the relay member 327*a*.

As illustrated in FIG. 13, when the user inserts the cartridge 101 to the apparatus main body A and executes the closing operation of the cartridge door 310 to move the cartridge door 310 from the opening position to the closing position, the pressing member 341*a* of the relay member 327*a* is in contact with the pressed face 133*a* of the cartridge 101. When the closing operation of the cartridge door 310 is further executed, the relay member 327*a* starts moving in a sliding manner with respect to the cartridge door 310, and the supporting portion 311*a* is separated from the regulation face 331*a* of the elongate hole 360*a*. At this time, the relay member 327*a* moves in a sliding manner with respect to the cartridge door 310 without making the pressing spring 342*a* compressed. Then, when the closing operation is further executed, the pressing member 340*a* of the relay member 327*a* is in contact with the pressed portion 351*a* while the pressing member 341*a* of the relay member 327*a* is in contact with the pressed face 133*a* of the cartridge 101 (see FIG. 15). By further executing the closing operation of the cartridge door 310 in the above state, the cartridge door 310 is eventually moved to the closing position while making the pressing spring 342*a* of the relay member 327*a* compressed (see FIG. 16).

As illustrated in FIG. 13, a distance L3 between the pressing members 340*a* and 341*a* of the relay member 327*a* is longer than a distance L4 between the pressed face 133*a* of the cartridge 101 and the pressed portion 351*a*. Because the pressing member 340*a* is arranged on one end of the pressing spring 342*a* whereas the pressing member 341*a* is arranged on another end thereof, the pressing spring 342*a* applies the urging force of the same intensity to each of the pressing members 340*a* and 341*a*. Therefore, similar to the first exemplary embodiment, the cartridge 101 can be urged while a position thereof is stably retained.

<Detachment of Cartridge from Image Forming Apparatus>

Figure 16:
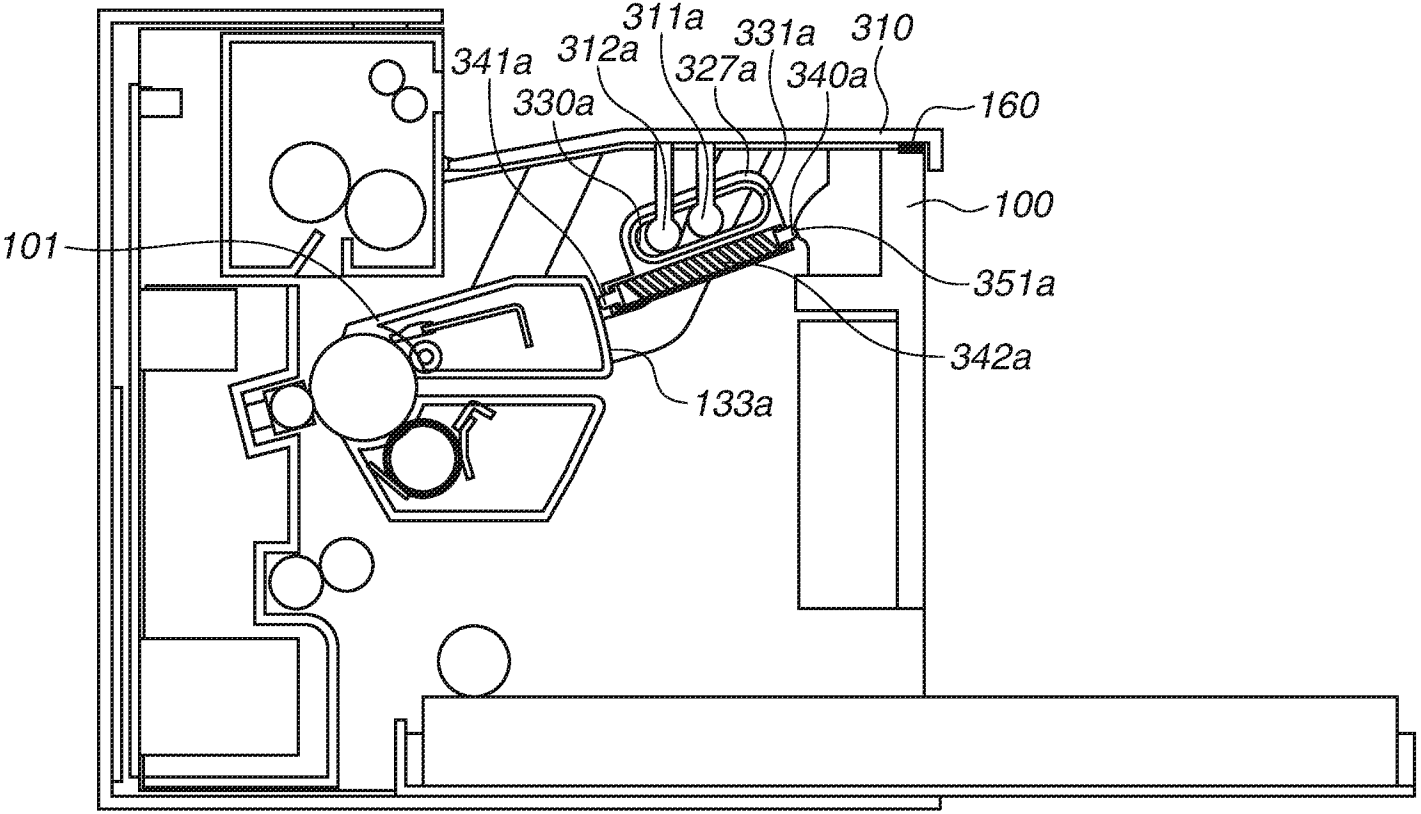
FIG. 16 is a cross-sectional diagram of the apparatus main body and the cartridge, which illustrates a state where the cartridge door of the image forming apparatus according to the third exemplary embodiment is closed.

A configuration for taking out the cartridge 101 from the apparatus main body A will be described. An operation opposite to the above-described operation of inserting the cartridge 101 will be executed as an operation of taking out the cartridge 101 from the apparatus main body A. In other words, an opening operation of the cartridge door 310 is executed in a state where the cartridge 101 is located at an image forming position, and the relay member 327*a* is in contact with both of the cartridge 101 and the pressed portion 351*a* as illustrated in FIG. 16. When the opening operation of the cartridge door 310 is executed, the relay member 327*a* is separated from the pressed portion 351*a* (see FIG. 14). Then, the relay member 327*a* is separated from the cartridge 101, so that the supporting portion 311*a* is brought into contact with the regulation face 131*a* of the elongate hole 360*a*. Then, when the cartridge door 310 is located at the opening position, the relay member 327*a* is moved to a position outside the insertion/removal track of the cartridge 101 as illustrated in FIG. 13.

Therefore, the cartridge 101 can be taken out from the inner portion of the apparatus main body A without being in contact with the relay member 327*a* that presses and holds the cartridge 101. Specifically, in the present exemplary embodiment, the relay member 327*a* is inserted in a direction intersecting with the pressing direction of the cartridge 101. Therefore, although the cartridge 101 is urged by the pressing spring 342*a* elastically deformed by the closing operation of the cartridge door 310, a strength necessary for the replacement work of the cartridge 101 can be reduced.

In the variation example, the two supporting portions 311*a* and 312*a* are located inside the elongate hole 360*a*, and the relay member 327*a* can move in a sliding manner by a predetermined width with respect to the cartridge door 310. However, a configuration in which the relay member 327*a* does not move rotationally with respect to the cartridge door 310 is not limited to the above. For example, one supporting portion formed into a substantially rectangular shape may be arranged inside the elongate hole 360*a*, so that the relay member 327*a* may slide with respect to the cartridge door 310 without moving rotationally.

Further, unlike the first exemplary embodiment, in the present exemplary embodiment, the pressing spring 342*a* is arranged on the relay member 327*a*, and the urging unit of the cartridge 101 is not arranged on the apparatus main body A. Therefore, the pressing spring 124*a* and the pressing lever 125*a* arranged in the first exemplary embodiment do not have to be arranged thereon, so that a space used for insertion or removal of the cartridge can be increased. Furthermore, the main body can be miniaturized by eliminating the space.

Similar to the second exemplary embodiment, in the present exemplary embodiment, the relay member 327*a* moves in a sliding manner with respect to the cartridge door 310. However, the configuration is not limited thereto, and similar to the first exemplary embodiment, the relay member 327*a* may be rotationally moved with respect to the cartridge door 310. Hence, various changes are possible within a scope of the present invention.

In the above-described exemplary embodiment, the relay member is held by the cartridge door, and even in a state where the cartridge is to be pressed, the relay member is in contact with the cartridge door. However, the configuration is not limited to the above. When the cartridge door is opened or closed, the relay member may be held by the cartridge door. Then, when the cartridge is to be pressed, the relay member may be positioned on the cartridge or the apparatus main body without being in contact with the cartridge door. As a fourth exemplary embodiment, a configuration in which a relay member is positioned on the cartridge or the apparatus main body A when the cartridge is pressed will be described. In addition, a reference numeral that is the same as the reference numeral in the first exemplary embodiment is applied to a configuration similar to that of the first exemplary embodiment, and description thereof will be omitted. Further, only a configuration of the drive side will be described. However, a configuration and an operation of the non-drive side are similar to those of the drive side unless otherwise specifically described.

<Configuration for Pressing Cartridge>

Similar to the first exemplary embodiment, a cartridge door 410 is held by a shaft bearing of the apparatus main body A in a rotationally movable state, and a relay member 427*a* is arranged on a face of the cartridge door 410 which faces a space inside the apparatus main body A where the cartridge 401 enters. More specifically, supporting portions 411*a* and 412*a* are arranged on a face of the cartridge door 410 which faces a space inside the apparatus main body A where the cartridge 401 enters. Then, the relay member 427*a* includes an elongate hole 430*a*, and the supporting portions 411*a* and 412*a* are arranged to engage with an internal portion of the elongate hole 430*a*. With this configuration, the relay member 427*a* can move in a sliding manner with respect to the supporting portions 411*a* and 412*a* as well as the cartridge door 410. In the present exemplary embodiment, the relay member 427*a* includes a pressing spring 424*a* serving as an elastic member, and a pressing member 440*a* is arranged on one end of the pressing spring 424*a*, whereas the relay member 427*a* is arranged on another end thereof. With this configuration, the pressing spring 424*a* of the relay member 427*a* applies a certain spring pressure in a direction in which the pressing member 440*a* and the relay member 427*a* are separated from each other. Further, the pressing member 440*a* is held by the retaining portion 470*a* while being held by the relay member 427*a* in a rotationally movable state. Therefore, the pressing member 440*a* is prevented from coming off or being rotated.

Figure 19:
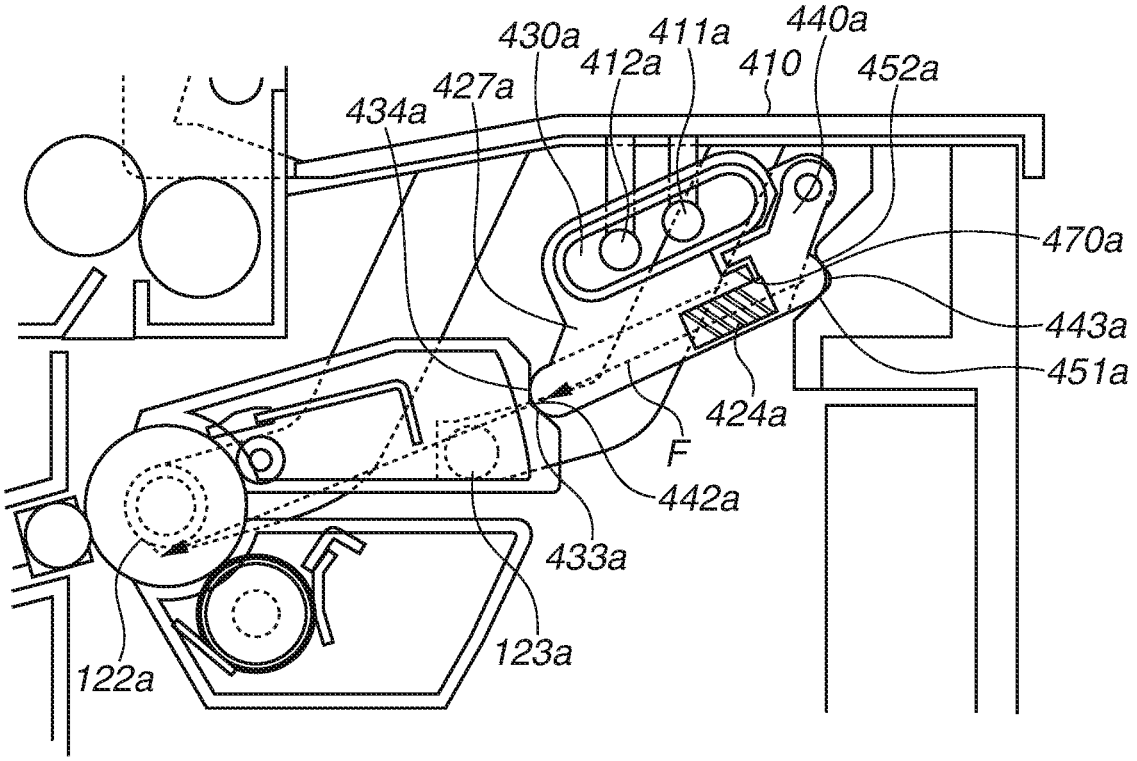
FIG. 19 is an enlarged cross-sectional diagram illustrating a state where the cartridge of the image forming apparatus according to the fourth exemplary embodiment is pressed.

In the present exemplary embodiment, as illustrated in FIG. 19, a pressing face 442*a* of the relay member 427*a* and a pressing face 443*a* of the pressing member 440*a* are formed into arc-like shapes. Then, a contact face 433*a* and a retracting face 434*a* of the cartridge 401, which are in contact with the pressing face 442*a* of the relay member 427*a*, constitute a V-shape positioning portion. Further, a contact face 451*a* and a retracting face 452*a* of the apparatus main body A, which are in contact with the pressing face 443*a* of the pressing member 440*a*, constitute a V-shape positioning portion. Then, because the pressing spring 424*a* applies spring pressure in a direction in which the pressing member 440*a* and the relay member 427*a* are separated from each other, the pressing face 442*a* of the relay member 427*a* and the pressing face 443*a* of the pressing member 440*a* which are formed into arc-like shapes respectively are positioned at the V-shape consisting of the contact face 433*a* and the retracting face 434*a* of the cartridge 401 and the V-shape consisting of the contact face 451*a* and the retracting face 452*a* of the apparatus main body A. Therefore, a vector F of the pressing force which is generated by the pressing spring 424*a* and applied to the cartridge 401 extends along a straight line that connects an arc center of the pressing face 442*a* of the relay member 427*a* and an arc center of the pressing face 443*a* of the pressing member 440*a*.

Figure 20:
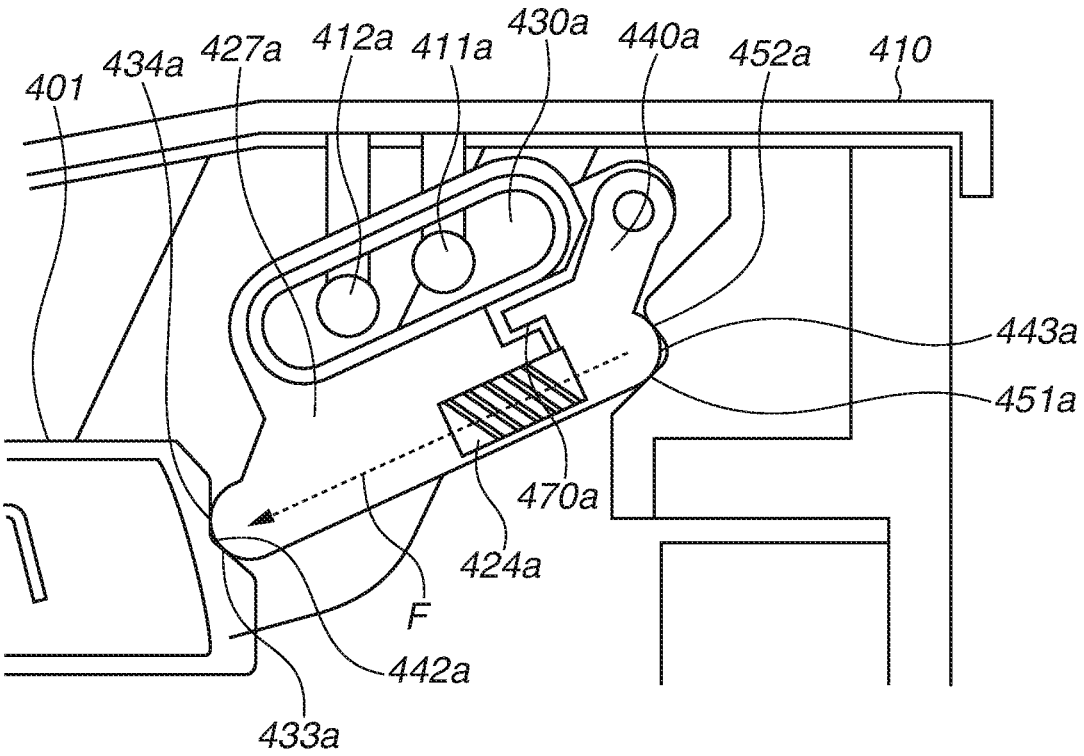
FIG. 20 is an enlarged cross-sectional diagram illustrating a state where the cartridge of the image forming apparatus according to the fourth exemplary embodiment is pressed.

As illustrated in FIG. 20, the vector F of the pressing force applied to the cartridge 401 extends along a straight line similar to a bisector of the V-shape consisting of the contact face 433*a* of the cartridge 401 and the retracting face 434*a*, and the straight line extends in a space between the positioning portion 122*a* and the rotation stopper portion 123*a* of the cartridge 401. Therefore, in the present exemplary embodiment, because both of the positioning portion 122*a* and the rotation stopper portion 123*a* of the cartridge 401 are thereby urged, the cartridge 401 can be more stably held. In a case where own weight or driving moment of the cartridge 401 is taken into consideration, similar to the first exemplary embodiment, the vector F of the pressing force applied to the cartridge 401 may pass through the rotation center of the photosensitive drum 102.

As described above, when the cartridge 401 is to be pressed, the relay member 427*a* and the pressing member 440*a* respectively are positioned by the cartridge 401 and the apparatus main body A. Therefore, the elongate hold 430*a* of the relay member 427*a* is arranged to have a gap between the supporting portions 411*a* and 412*a*, and the relay member 427*a* is not in contact with the cartridge door 410 when the cartridge door 410 is closed. Thus, the pressing force can be stably applied to the cartridge 401 without being influenced by the position of the cartridge door 401.

<Attachment of Cartridge to Image Forming Apparatus>

Next, with reference to FIG. 18 and FIGS. 21 to 23, an operation of urging and inserting the cartridge 401 to the image forming position by the relay member 427*a* after the user opens the cartridge door 410 to insert the cartridge 401 from the formed opening portion 666 will be sequentially described.

Figure 18:
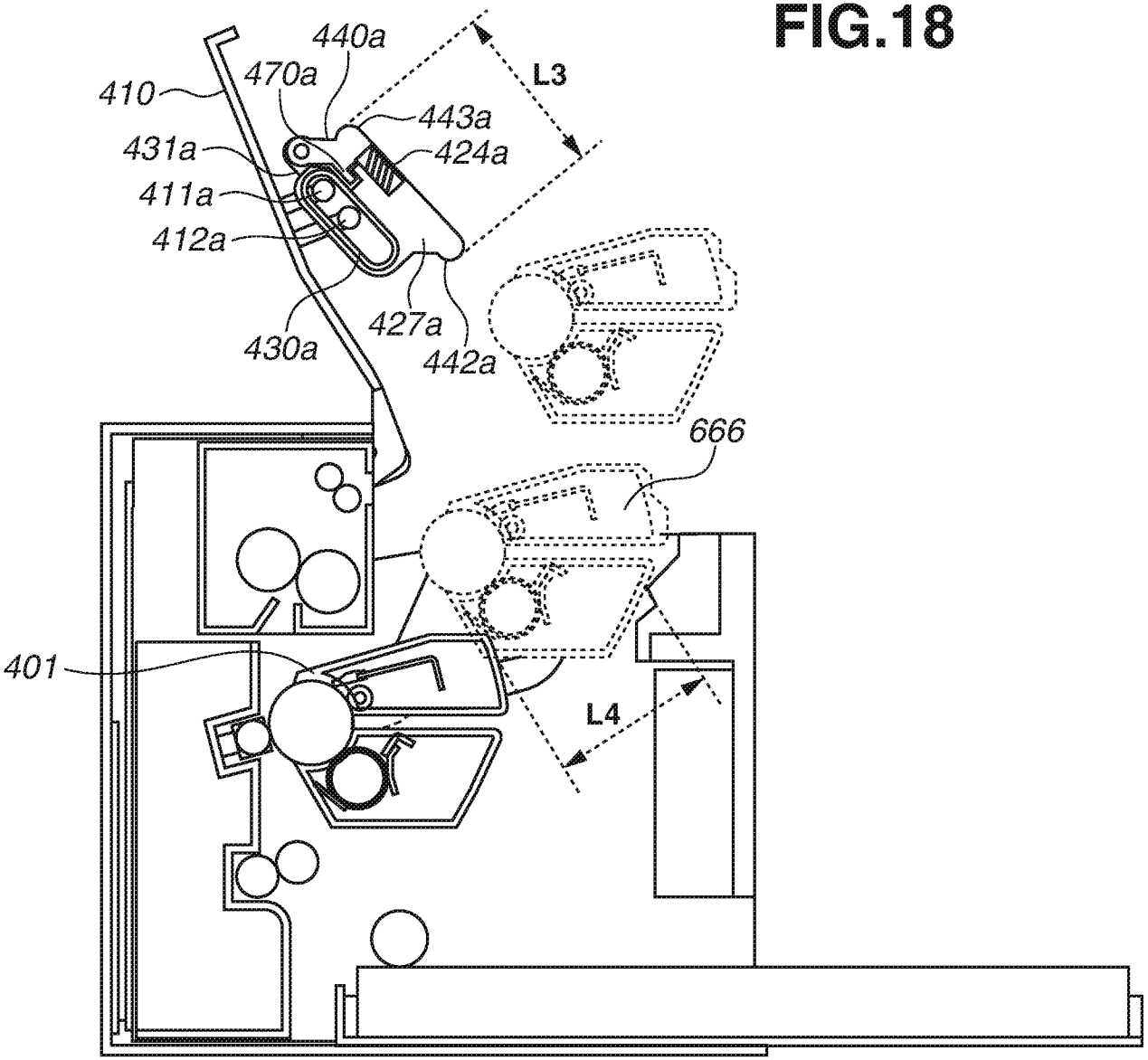
FIG. 18 is a diagram illustrating an apparatus main body of an image forming apparatus and an insertion/removal track and positioning of a cartridge according to a fourth exemplary embodiment.

The user opens the cartridge door 410 and inserts the cartridge 401 to make the positioning portion 122*a* and the rotation stopper portion 123*a* of the cartridge 401 respectively held by the guides 114*a* and 115*a* of the apparatus main body A. An orientation of the cartridge 401 is determined when the cartridge 401 is held by the two guides 114*a* and 115*a*, and the cartridge 401 is moved according to the shapes of the guides 114*a* and 115*a*. Accordingly, the cartridge 401 is moved while following an insertion/removal track of the cartridge 401 as illustrated in FIG. 18. When the cartridge door 410 is opened, the relay member 427*a* is held at a position outside the insertion/removal track of the cartridge 401 in an orientation in which the supporting portion 411*a* is in contact with the regulation face 431*a* of the elongate hole 430*a* because of the gravitational force.

As a result, insertion or removal of the cartridge 401 will not be interrupted because the relay member 427*a* is located at a position outside the insertion/removal track of the cartridge 401. Accordingly, when the cartridge 401 is to be inserted, the cartridge 401 can be inserted to the apparatus main body A without being in contact with the relay member 427*a*.

Figure 21:
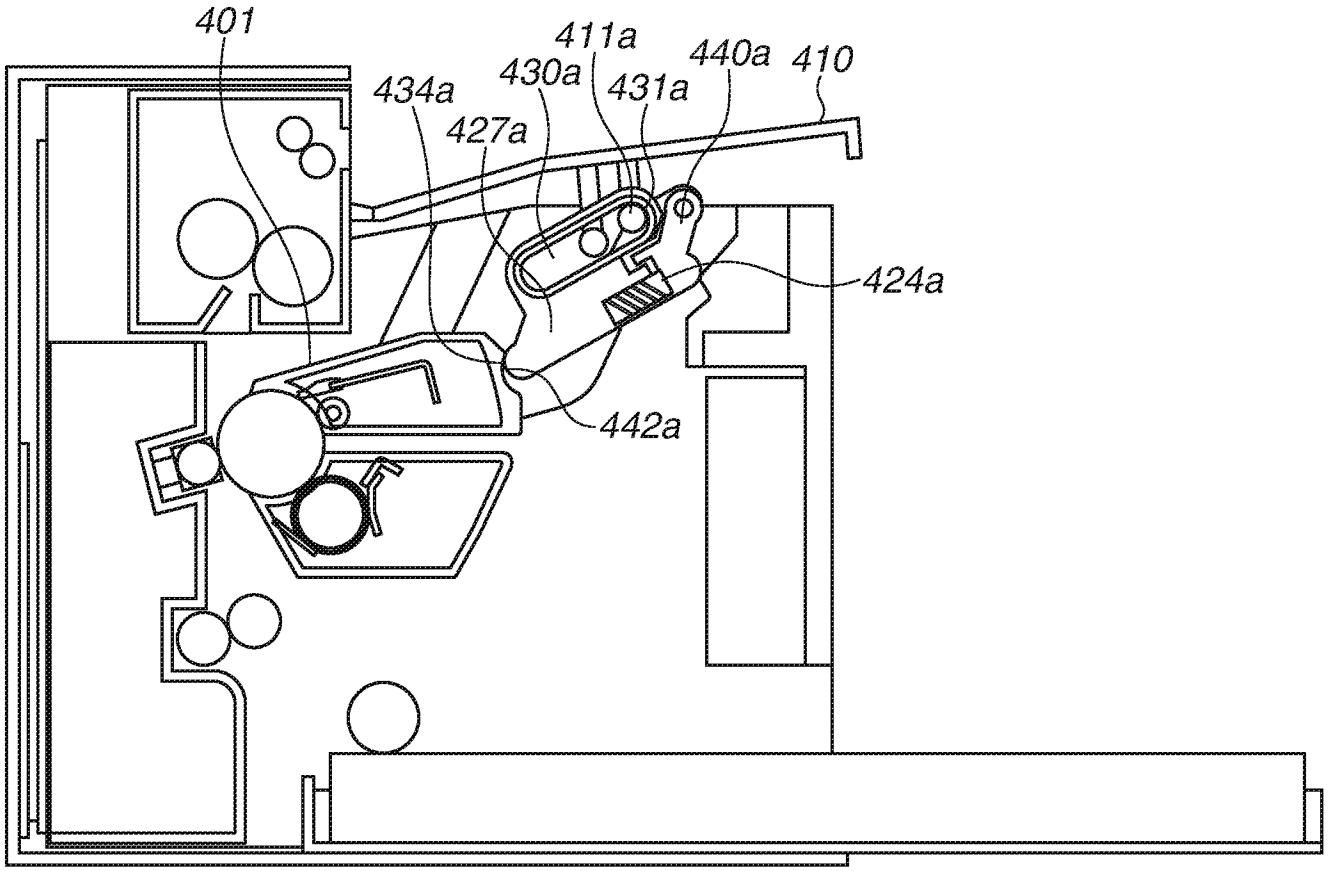
FIG. 21 is a cross-sectional diagram of the apparatus main body and the cartridge, which illustrates a state where a cartridge door of the image forming apparatus according to the fourth exemplary embodiment is opened or closed halfway.
Figure 22:
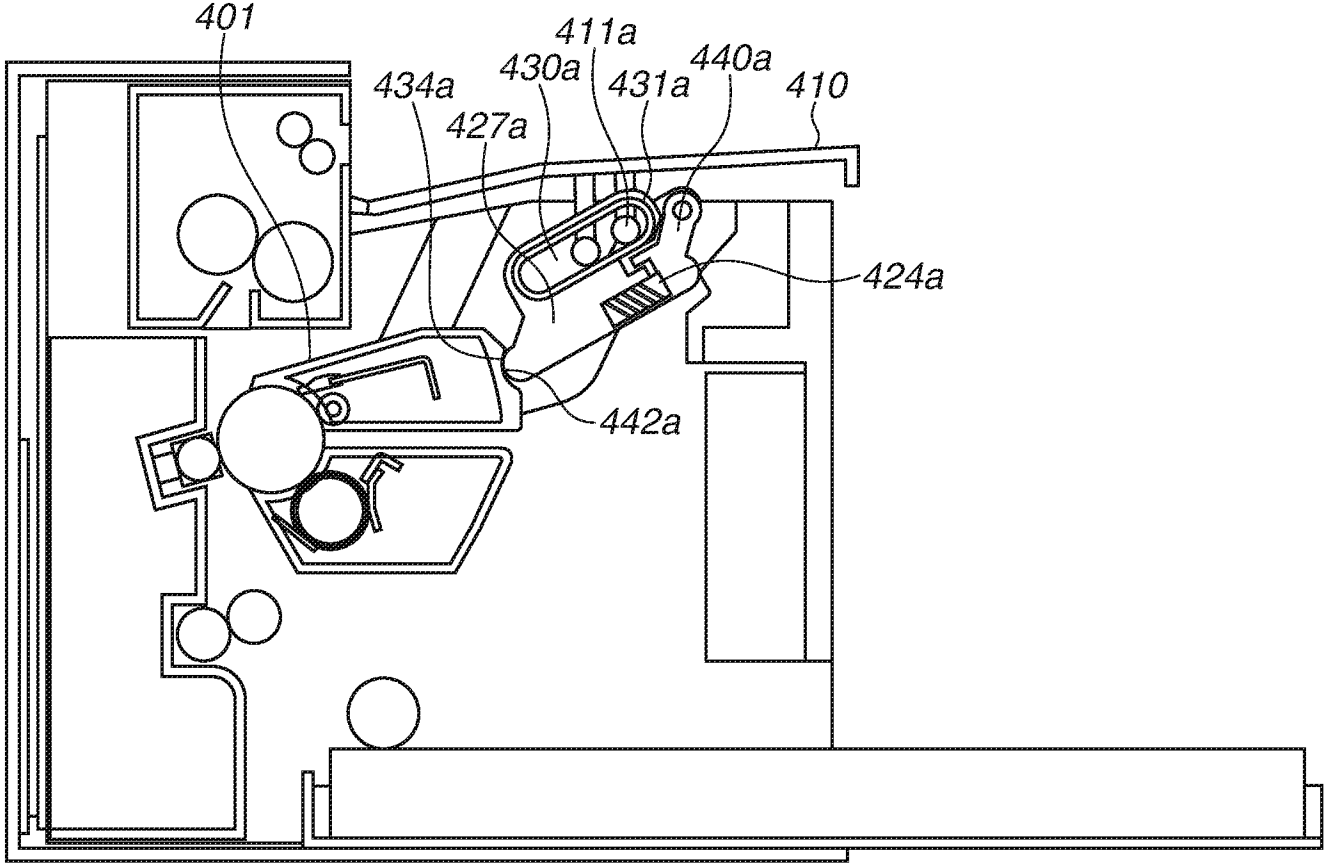
FIG. 22 is a cross-sectional diagram of the apparatus main body and the cartridge, which illustrates a state where the cartridge door of the image forming apparatus according to the fourth exemplary embodiment is further closed than in the state in FIG. 21.

As illustrated in FIG. 18, when the user inserts the cartridge 401 to the apparatus main body A and executes a closing operation of the cartridge door 410 to move the cartridge door 410 from the opening position to the closing position, the pressing face 442*a* of the relay member 427*a* is in contact with the retracting face 434*a* of the cartridge 401 (see FIG. 21). When the closing operation of the cartridge door 410 is further executed, the relay member 427*a* starts moving in a sliding manner with respect to the cartridge door 410, and the supporting portion 411*a* is separated from the regulation face 431*a* of the elongate hole 430*a*. At this time, the relay member 427*a* moves in a sliding manner with respect to the cartridge door 410 without making the pressing spring 424*a* compressed (see FIG. 22). Then, when the closing operation is further executed, the pressing face 443*a* of the pressing member 440*a* of the relay member 427*a* is in contact with the apparatus main body A while the pressing member 440*a* of the relay member 427*a* is in contact with the retracting face 434*a* of the cartridge 401. By further executing the closing operation of the cartridge door 410 in the above state, the retracting face 452*a* of the apparatus main body A causes the pressing face 443*a* of the pressing member 440*a* to compress the pressing spring 424*a* of the relay member 427*a*, so that the relay member 427*a* and the pressing member 440*a* are retracted to determined positions. The cartridge door 410 is eventually moved to the closing position (see FIG. 23).

As illustrated in FIG. 18, a distance L3 between the pressing face 442*a* of the relay member 427*a* and the pressing face 443*a* of the pressing member 440*a* is longer than a distance L4 between the V-shape consisting of the contact face 433*a* and the retracting face 434*a* of the cartridge 401 and the V-shape consisting of the contact face 451*a* and the retracting face 452*a* of the apparatus main body A. Because the pressing member 440*a* is arranged on one end of the pressing spring 424*a* whereas the relay member 427*a* is arranged on another end thereof, the pressing spring 424*a* applies the urging force of the same intensity to each of the pressing member 440*a* and the relay member 427*a*.

Therefore, similar to the first exemplary embodiment, the cartridge 401 can be urged while a position thereof is stably retained. Further, because the supporting portions 411*a* and 412*a* of the cartridge door 410 are not in contact with the elongate hole 430*a* of the relay member 427*a*, the cartridge 401 can be more stably urged and held without being influenced by the cartridge door 410. Furthermore, because the relay member 427*a* and the pressing member 440*a* are retracted to the positioned place together with the cartridge door 410, the relay member 427*a* and the pressing member 440*a* including the cartridge door 410 can be suppressed from being stopped halfway.

<Detachment of Cartridge from Image Forming Apparatus>

Figure 23:
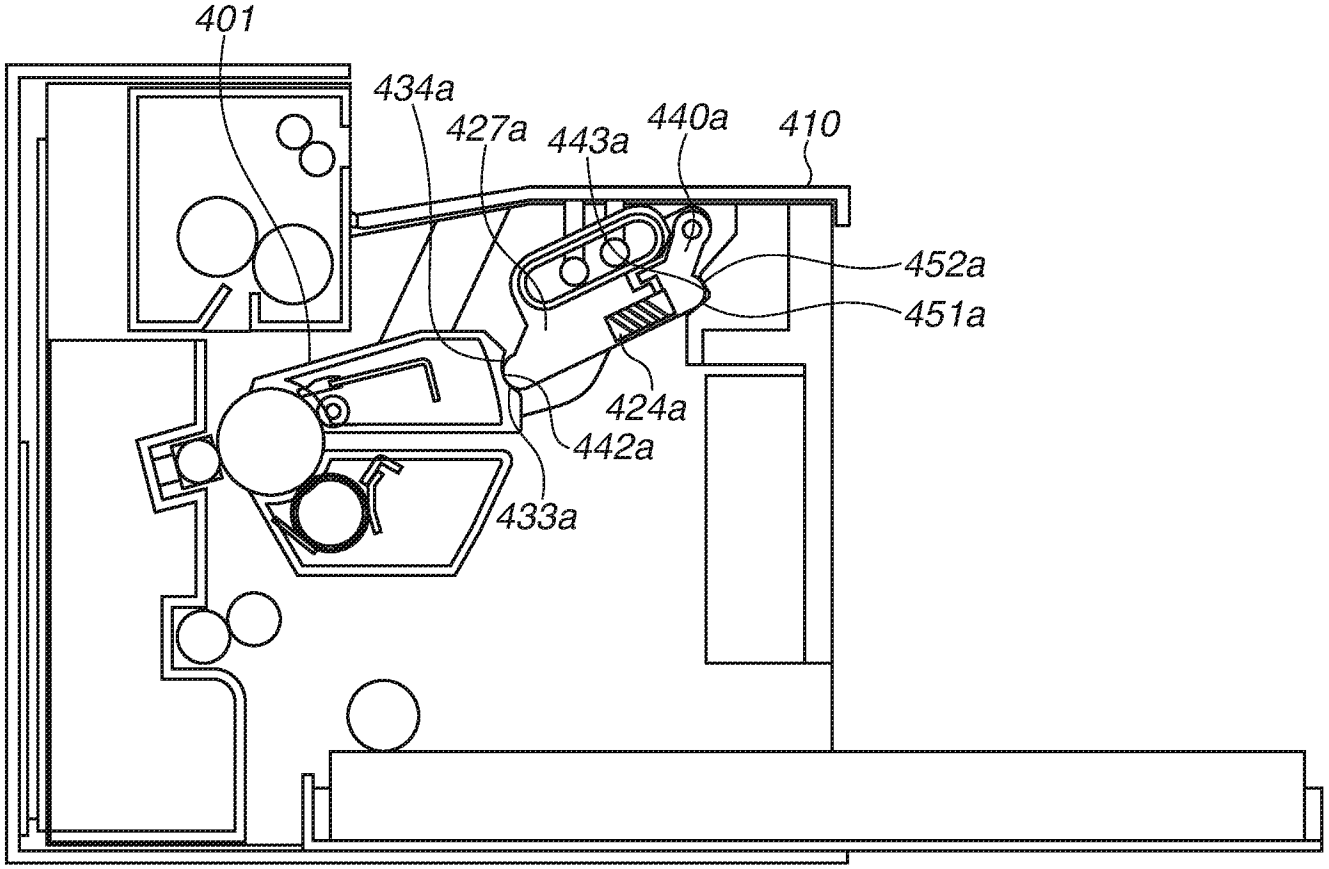
FIG. 23 is a cross-sectional diagram of the apparatus main body and the cartridge, which illustrates a state where the cartridge door of the image forming apparatus according to the fourth exemplary embodiment is closed.

A configuration for taking out the cartridge 401 from the apparatus main body A will be described. An operation opposite to the above-described operation of inserting the cartridge 401 will be executed as an operation of taking out the cartridge 401 from the apparatus main body A. In other words, an opening operation of the cartridge door 410 is executed in a state where the cartridge 401 is located at the image forming position, and the relay member 427*a* is in contact with the cartridge 401, whereas the pressing member 440*a* is in contact with the apparatus main body A as illustrated in FIG. 23. When the opening operation of the cartridge door 410 is executed, the pressing member 440*a* is separated from the retracting face 452*a* (see FIG. 22). Then, the relay member 427*a* is separated from the cartridge 401, so that the supporting portion 411*a* is eventually brought into contact with the regulation face 431*a* of the elongate hole 430*a* (see FIG. 21). When the cartridge door 410 is located at the opening position, the relay member 427*a* is moved to a position outside the insertion/removal track of the cartridge 401 as illustrated in FIG. 18.

Therefore, the cartridge 401 can be taken out from the inner portion of the apparatus main body A without being in contact with the relay member 427*a* that presses and holds the cartridge 401. Specifically, in the present exemplary embodiment, the relay member 427*a* is inserted in a direction intersecting with the pressing direction of the cartridge 401. Because the pressing spring 424*a* is elastically deformed by a requisite minimum amount through the closing operation of the cartridge door 410, a strength necessary for the replacement work of the cartridge 401 can be reduced even if the cartridge 401 is urged.

Figure 24:
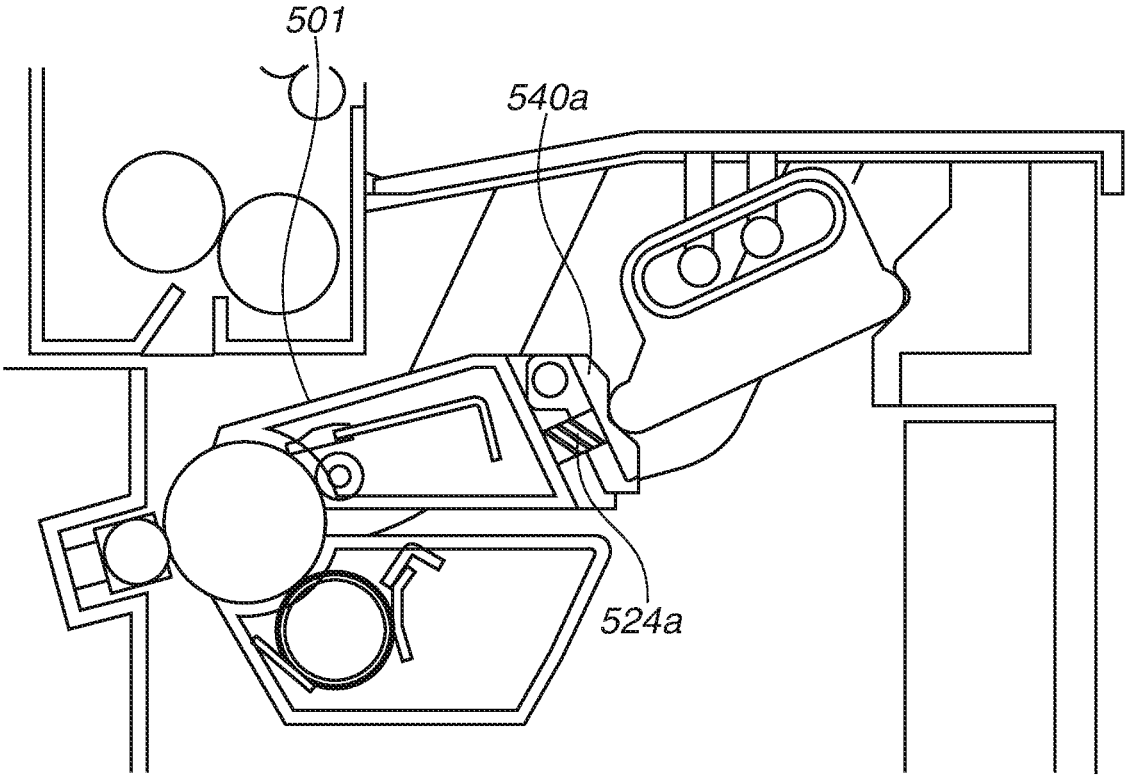
FIG. 24 is an enlarged cross-sectional diagram illustrating a state where a cartridge of an image forming apparatus according to a variation example of the fourth exemplary embodiment is pressed.

In the variation example, the pressing spring 424*a* is arranged on the relay member 427*a*, and the urging unit of the cartridge 101 is not arranged on the apparatus main body A. However, as illustrated in FIG. 24, a pressing member 540*a* and a pressing spring 524*a* may be arranged on a cartridge 501. With this configuration, a pressing force applied to the cartridge 501 can be generated by the pressing spring 524*a* arranged on the cartridge 501, so that the pressing force can be changed by the cartridge 501.

In the variation example, the two supporting portions 411*a* and 412*a* are located inside the elongate hole 430*a*, and the relay member 427*a* can move in a sliding manner by a predetermined width with respect to the cartridge door 410. However, a configuration in which the relay member 427*a* does not move rotationally with respect to the cartridge door 410 is not limited to the above. For example, one supporting portion formed into a substantially rectangular shape may be arranged inside the elongate hole 430*a*, so that the relay member 427*a* may slide with respect to the cartridge door 410 without moving rotationally.

Furthermore, different from the first exemplary embodiment, in the present exemplary embodiment, the pressing spring 424*a* is arranged on the relay member 427*a*, and the urging unit of the cartridge 401 is not arranged on the apparatus main body A. Therefore, the pressing spring 124*a* and the pressing lever 125*a* arranged in the first exemplary embodiment do not have to be arranged thereon, so that a space used for insertion or removal of the cartridge 401 can be increased. Further, the main body can be miniaturized by eliminating the space.

Further, similar to the second exemplary embodiment, in the present exemplary embodiment, the relay member 427*a* moves in a sliding manner with respect to the cartridge door 410. However, the configuration is not limited thereto. Similar to the first exemplary embodiment, the relay member 427*a* may be rotationally moved with respect to the cartridge door 410. Therefore, various changes are possible within a scope of the present invention.

In a configuration described in a fifth exemplary embodiment, a relay member 650 is arranged on a portion of the apparatus main body A that is immovable together with the cartridge door 110. The other configurations are similar to those described in the first exemplary embodiment.

Figure 25A:
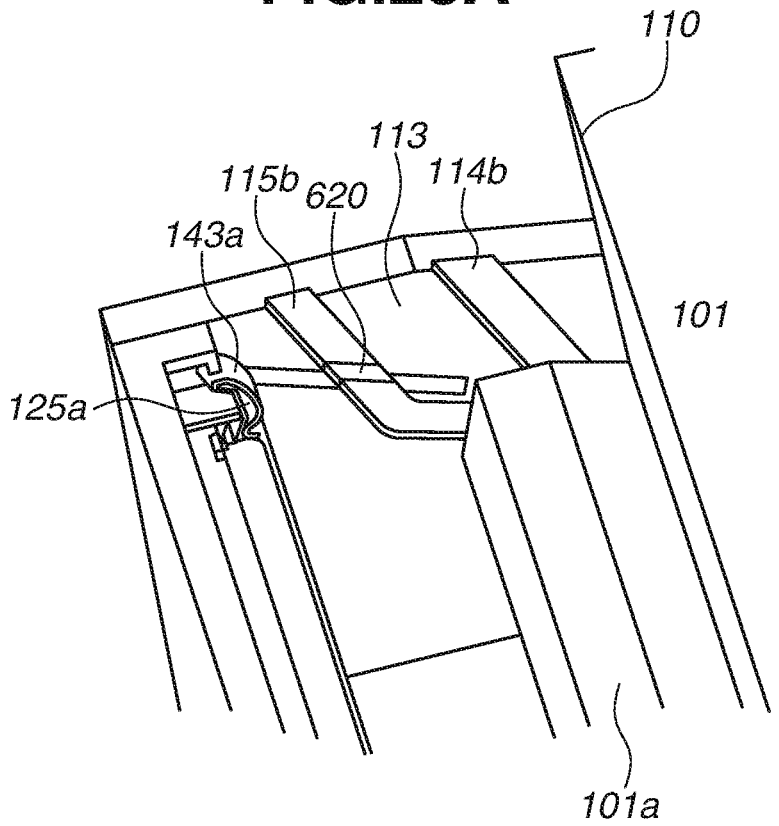
FIGS. 25A and 25B are perspective diagrams partially illustrating one of side plates of an apparatus main body of an image forming apparatus according to a fifth exemplary embodiment.
Figure 25B:
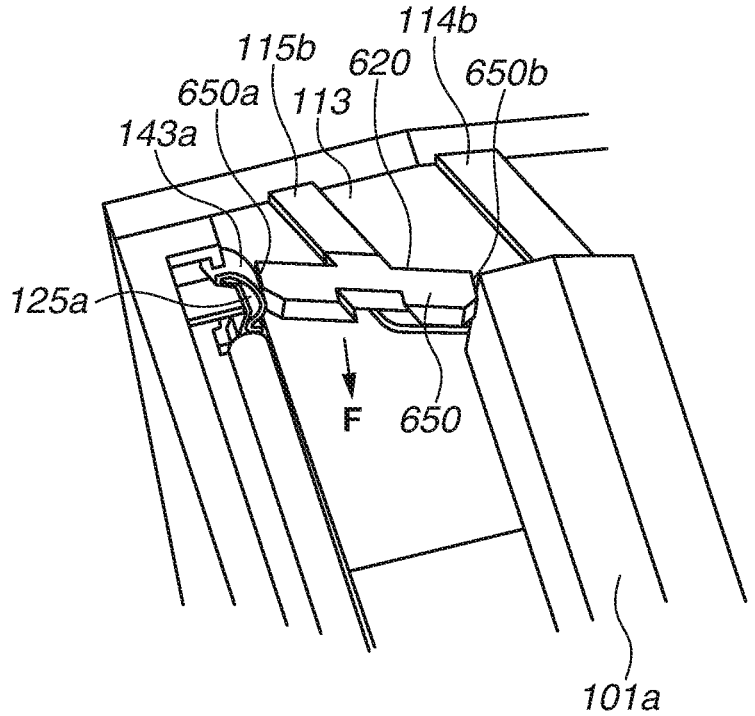

FIG. 25A is a perspective diagram of a part of an inner portion of the apparatus main body A on a side of the side plate 113, illustrating a state where the cartridge 101 (drum unit 101*a*) is attached, and the cartridge door 110 is opened. A slit 620 is arranged in the side plate 113 on which the guides 114*b* and 115*b* are arranged. The relay member 650 (not illustrated) is arranged on the outside of the slit 620. Further, in FIG. 25A, a pressing face 143*a* of the pressing lever 125*a* and the drum unit 101*a* have nothing in between. In other words, the relay member 650 is located at a position (second position) at which the relay member 650 is not held between the pressing face 143*a* of the pressing lever 125*a* and the drum unit 101*a*. On the other hand, FIG. 25B is a perspective diagram of a part of the inner portion of the apparatus main body A on a side of the side plate 113, illustrating a state where the cartridge 101 is attached, and the cartridge door 110 (not illustrated) is closed. The relay member 650 is projected to the inner side of the apparatus main body A in a direction indicated by an arrow F from the slit 620 of the side plate 113. Then, one end 650*a* of the relay member 650 is in contact with the pressing face 143*a* of the pressing lever 125*a*, whereas another end 650*b* of the relay member 650 is in contact with the pressed face 133*a* of the drum unit 101*a*. In other words, the relay member 650 is located at a position (first position) at which the relay member 650 is held between the pressing face 143*a* of the pressing lever 125*a* and the pressed face 133*a* of the drum unit 101*a*. Similar to the first exemplary embodiment, at the first position, the relay member 650 urges the cartridge 101 to make the cartridge 101 abut on the abutting portion 120*a* of the apparatus main body A, so that the position with respect to the apparatus main body A is determined. The relay member 650 can be moved between the first position and the second position in conjunction with the movement of the cartridge door 110.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

a first unit including an image bearing member capable of rotating while bearing a toner image;

a second unit including a development member which supplies toner to the image bearing member to develop the toner image;

an apparatus main body to which the first unit is detachably attached in a direction intersecting with a rotation axis of the image bearing member, the apparatus main body including an opening portion through which the first unit passes when the first unit is to be attached to or detached from the apparatus main body, an opening-closing member which can be moved to open or close the opening portion, a first portion which is in contact with a part of the first unit to position the first unit with respect to the apparatus main body, and a second portion, which does not move together with the opening-closing member, arranged on an opposite side of the first portion with respect to the image bearing member in the intersecting direction; and a sandwiched unit configured to be movable between a first position at which the sandwiched unit is sandwiched between the first unit and the second portion to press the first unit against the first portion and a second position at which the sandwiched unit is not sandwiched between the first unit and the second portion, wherein, when the sandwiched unit is located at the first position, a part of the first unit is urged and brought into contact with the first portion by the sandwiched unit.

2. An image forming apparatus comprising:

a cartridge that includes a roller and a portion-to-be-positioned; and an apparatus main body to which the cartridge is detachably attachable, the apparatus main body including:

an opening through which the cartridge passes when the cartridge is attached to the apparatus main body;

an opening and closing member configured to move between an opening position where the opening are not covered by the opening and closing member and a closing position where the opening is covered by the opening and closing member;

a positioning portion for positioning the cartridge with respect to the apparatus main body by contacting with the portion-to-be-positioned of the cartridge;

a first sandwiching portion configured not to move together with the opening and closing member; and a sandwiched unit including an elastic member and configured to move between a first position and a second position different from the first position, the first position being a position where the sandwiched unit is sandwiched between the first sandwiching portion and a second sandwiching portion of the cartridge, the second position being a position where the sandwiched unit is not sandwiched between the sandwiching portion and the second sandwiching portion of the cartridge, wherein when the sandwiched unit is in the first position, the sandwiched unit presses the second sandwiching portion of the cartridge by an elastic force of the elastic member so that the portion-to-be-positioned of the cartridge contacts with the positioning portion of the apparatus main body.

3. The image forming apparatus according to claim 2, wherein the sandwiched unit includes a first pressing member, a second pressing member, and a compressing spring provided between the first pressing member and the second pressing member, and wherein when the sandwiched unit is in the first position, the compressing spring is compressed between the first pressing member and the second pressing member so that the first pressing member and the second pressing member presses the second sandwiching portion of the cartridge and the first sandwiching portion, respectively.

4. The image forming apparatus according to claim 3, wherein the first pressing member is supported by the opening and closing member, and the second pressing member is coupled to the first pressing member so as to be movable with respect to the first pressing member.

5. The image forming apparatus according to claim 3, wherein the sandwiched unit includes a frame holding the first pressing member, the second pressing member, and the compressing spring, and wherein the frame is supported by the opening and closing member when the sandwiched unit is in the second position.

6. The image forming apparatus according to claim 2, wherein the cartridge includes a frame, and wherein the second sandwiching portion of the cartridge is a concave of the frame recessed toward the roller, and the concave of the frame has a first surface and a second surface that extend so that a distance therebetween becomes smaller in a direction in which the concave of the frame is recessed, and wherein both the first surface and the second surface of the concave of the frame contacts with the sandwiched unit when the sandwiched unit is in the first position.

7. The image forming apparatus according to claim 6, wherein the concave of the frame is configured so that each of a pressing force applied on the first surface and a pressing force applied on the second surface becomes a force to bring the portion-to-be-positioned of the cartridge into contact with the positioning portion of the apparatus main body when the sandwiched unit is in the first position.

8. The image forming apparatus according to claim 2, wherein when the sandwiched unit is in the first position, on a cross section perpendicular to a rotational axis of the roller, the positioning portion of the apparatus main body, the first sandwiching portion, and the second sandwiching portion are arranged so that a virtual straight line passing through both the first sandwiching portion and the second sandwiching portion passes through the positioning portion of the apparatus main body.

9. The image forming apparatus according to claim 2, wherein the sandwiched unit is in the first position when the opening and closing member is in the closing position, and the sandwiched unit is in the second position when the opening and closing member is in the opening position.

10. The image forming apparatus according to claim 2, wherein the sandwiched unit is supported by the opening and closing member when the sandwiched unit is in the second position.

11. The image forming apparatus according to claim 10, wherein when the sandwiched unit is in the second position, the sandwiched unit is outside a moving path through which the cartridge passes while the cartridge is attached to the apparatus main body.

12. The image forming apparatus according to claim 11, wherein the sandwiched unit is supported by the opening and closing member so as to rotate with respect to the opening and closing member, wherein the opening and closing member includes a regulating portion regulating a rotating of the sandwiched unit so that the sandwiched unit is outside the moving path when the sandwiched unit is in the second position.

13. The image forming apparatus according to claim 10, wherein when the sandwiched unit is in the first position, the sandwiched unit is not supported by the opening and closing member.

14. The image forming apparatus according to claim 2, wherein the roller is a photosensitive drum.

15. A cartridge detachably attachable to an apparatus main body of an image forming apparatus, the apparatus main body including an opening through which the cartridge passes when the cartridge is attached to the apparatus main body, an opening and closing member configured to move between an opening position where the opening are not covered by the opening and closing member and a closing position where the opening is covered by the opening and closing member, a positioning portion for positioning the cartridge, a first sandwiching portion configured not to move together with the opening and closing member, and a sandwiched unit movable between a first position and a second position different from the first position, the cartridge comprising:

a roller;

a frame;

a portion-to-be-positioned that is to be contacted with the positioning portion of the apparatus main body to position the cartridge with respect to the apparatus main body; and a second sandwiching portion provided on the frame and configured to sandwich the sandwiched unit with the first sandwiching portion of the apparatus main body when the sandwiched unit is in the first position, the second sandwiching portion being a concave of the frame recessed toward the roller, the concave of the fame having a first surface and a second surface that face each other and extend so that a distance therebetween becomes smaller in a direction in which the concave of the frame is recessed, wherein the first surface and the second surface of the concave of the frame are configured to contact with the sandwiched unit when the cartridge is attached to the apparatus main body and the sandwiched unit is in the first position.

16. The cartridge according to claim 15, wherein the concave of the frame is configured so that when the cartridge is attached to the apparatus main body and the sandwiched unit is in the first position, each of a pressing force applied on the first surface and a pressing force applied on the second surface from the sandwiched unit becomes a force to bring the portion-to-be-positioned of the cartridge into contact with the positioning portion of the apparatus main body.

17. The cartridge according to claim 15, wherein the second sandwiching portion sandwiches the sandwiched unit with the first sandwiching portion, thereby the portion-to-be-positioned contacting with the positioning portion of the apparatus main body.

18. The cartridge according to claim 15, wherein the roller is a photosensitive drum.

* * * * *